US008726535B2

(12) United States Patent
Garrido et al.

(10) Patent No.: US 8,726,535 B2
(45) Date of Patent: May 20, 2014

(54) METHOD, APPARATUS AND SYSTEM FOR CONTROLLING HEATED AIR DRYING

(75) Inventors: Mario Garrido, Santiago (CL); Roberto Vargas, Santiago (CL); Christian Violic, Las Condes (CL)

(73) Assignee: Pioneer Hi Bred International Inc, Johnston, IA (US)

( * ) Notice: Subject to any disclaimer, the term of this patent is extended or adjusted under 35 U.S.C. 154(b) by 879 days.

(21) Appl. No.: 12/638,501

(22) Filed: Dec. 15, 2009
(Under 37 CFR 1.47)

(65) Prior Publication Data

US 2010/0229420 A1 Sep. 16, 2010

Related U.S. Application Data

(60) Provisional application No. 61/122,878, filed on Dec. 16, 2008.

(51) Int. Cl.
*F26B 19/00* (2006.01)
*F26B 21/14* (2006.01)

(52) U.S. Cl.
USPC ..... 34/218; 34/493; 34/524

(58) Field of Classification Search
USPC ..... 34/493, 218, 524; 415/182.1, 121.2
See application file for complete search history.

(56) References Cited

U.S. PATENT DOCUMENTS

| | | | | |
|---|---|---|---|---|
| 3,583,688 | A | 6/1971 | Fuqua et al. | |
| 3,699,665 | A * | 10/1972 | Shinskey | 34/549 |
| 4,253,244 | A | 3/1981 | Kranzler | |
| 4,270,280 | A | 6/1981 | McClaren | |
| 4,397,101 | A | 8/1983 | Rickard | |
| 4,558,523 | A | 12/1985 | Isbell et al. | |
| 4,583,300 | A | 4/1986 | Mast | |
| 4,800,653 | A * | 1/1989 | Steffen | 34/495 |
| 5,467,535 | A | 11/1995 | Lentz | |
| 5,755,041 | A * | 5/1998 | Horwitz | 34/491 |
| 5,797,196 | A | 8/1998 | Stanfield | |
| 5,893,218 | A | 4/1999 | Hunter et al. | |
| 6,085,443 | A | 7/2000 | Hunter et al. | |
| 6,163,978 | A | 12/2000 | Hinner | |
| 6,330,754 | B1 | 12/2001 | McAllister | |
| 6,530,160 | B1 | 3/2003 | Gookins | |
| 6,747,461 | B2 * | 6/2004 | Corak et al. | 324/643 |
| 2007/0193056 | A1 * | 8/2007 | Switalski | 34/88 |
| 2009/0094853 | A1 | 4/2009 | Noyes et al. | |
| 2009/0191091 | A1 | 7/2009 | Danchenko et al. | |
| 2011/0252663 | A1 | 10/2011 | Ralph et al. | |

FOREIGN PATENT DOCUMENTS

| | | | |
|---|---|---|---|
| CN | 102692117 | A | 9/2012 |
| JP | 2592996 | B2 | 7/1992 |
| JP | 5106965 | A | 4/2009 |
| JP | 5106967 | A | 4/2009 |
| JP | 2009/109137 | A | 5/2009 |
| JP | 2009/198047 | A | 9/2009 |
| JP | 2010/144969 | A | 7/2010 |
| JP | 2010/271021 | A | 12/2010 |
| WO | WO-97/29333 | A1 | 8/1997 |

* cited by examiner

*Primary Examiner* — Kenneth Rinehart
*Assistant Examiner* — John McCormack
(74) *Attorney, Agent, or Firm* — Pioneer Hi-Bred International

(57) ABSTRACT

An apparatus, system and method of controlling heated air drying of product. Exhaust temperature is measured during drying and compared to a target or ideal exhaust temperature function or reference. The exhaust temperature function or reference is correlated to a target or ideal drying rate for the product. Drying factors are adjusted to compensate for variance between measured exhaust temperature and the target or ideal exhaust temperature function to influence actual exhaust temperature to follow the target or ideal exhaust temperature function during drying. Drying factors such as inlet air temperature and drying pressure can be controlled manually or automatically by the comparison to promote efficient and controlled drying.

20 Claims, 25 Drawing Sheets

METHOD, APPARATUS AND SYSTEM FOR CONTROLLING HEATED AIR DRYING

CROSS-REFERENCE TO RELATED APPLICATIONS

This application claims priority under 35 U.S.C. §119 to provisional application Ser. No. 61/122,878 filed Dec. 16, 2008, herein incorporated by reference in its entirety.

FIELD OF THE INVENTION

The present invention relates to drying processes and, in particular, to monitoring and controlling the drying of products by application of heated air.

BACKGROUND

A variety of drying techniques exist to remove water moisture by evaporation from a product. One common technique is forced air drying. Fans pressurize dryers and air movement occurs from an area of high pressure towards the atmosphere (0 pressure). Forced air is used to dry many products. One example is grains, including but not limited to corn, wheat, soybean, rice, sorghum, sunflower seed, rapeseed/canola, barley, and oats. Other seed, or other particulates or granular products, can also be dried with heated air.

Raising the temperature of the drying air increases the moisture-carrying capacity of the air and decreases the relative humidity. As a general rule of thumb with grain, increasing the air temperature by 6.67° C. (approximately 20° F.) doubles the moisture holding capacity of air and cuts the relative humidity in half. The drying rate depends on the difference in moisture content between the drying air and the grain kernels. The rate of moisture movement from high moisture grain to low relative humidity air can be rapid. Airflow rate also affects drying rate. Air carries moisture away from the grain, and higher airflow rates give higher drying rate. Airflow is determined by fan design and speed, fan motor size, and the resistance to the grain to airflow.

While heated air drying is conducive to a wide variety of drying applications of granular or particulate products, there can be constraints on the process. For example, many times product quality considerations limit such things as the drying air temperature or drying rate.

Heated air drying can be energy-intensive. Hotter heated air and higher drying pressures consume more energy than cooler heater air and lower drying pressures. But cooler air temperatures and lower drying pressures extend the drying period, which can result in cumulative energy consumption on par or exceeding hotter air and higher drying pressures. Therefore, energy efficiency can be a desirable goal of heated air drying. A specific example of the above-described issues relates to parent or commercial corn seed. For many of the foregoing reasons, drying harvested corn seed, such as parent or commercial corn seed, is not trivial. Several factors contribute to this. Some of these factors can be antagonistic to one another.

Many times there is also a limit on how much moisture should be removed from the product. For example, it is desirable to dry seed and grain to reduce such things as bacterial growth, decay, molding, or rotting during shipment or storage, but to leave a fraction of initial moisture in place for seed quality and germination potential. Therefore, drying of many products requires considerable control of the drying process to avoid violating these types of limitations.

Such seed can be damaged or its quality affected if drying rate (e.g., in hours per percentage point of seed moisture loss ("hrs/pt")) falls much below a threshold. One standard for parent seed is a minimum drying rate of at least 4.0 hrs/pt. For commercial seed, as opposed to parent seed, 4.0 hrs/pt is still a goal but some tolerance may be allowed (e.g., rates should be above 3.5 hrs/pt). But many commercial heated air dryers are difficult to operate at a constant drying rate to maintain precise control of the drying process. Therefore, seed companies tend to operate dryers in a manner that results in average higher drying rates. Many commercial seed dryers are operated in a manner which results in an average drying rate over the 4.0 hrs/pt ideal drying rate. For example, many operate more in the range of 4.5 hrs/pt or more. However, a drying rate around 4.5 hrs/pt can represent on the order of 12.5% below when compared to operation at 4.0 hrs/pt. The result is longer drying times, which not only requires more time but can consume more energy. The drying process thus suffers in efficiency. Therefore, safe drying conflicts with efficient drying. As mentioned previously, drying air temperature should stay below a limit for seed quality. Therefore, although hotter air could speed up drying, it risks damage to the seed. Even with electronic control of air temperature and air flow, it is still difficult to maintain drying rate within limits.

Also, as is well-known in the commercial seed industry, there can be significant time pressures associated with drying such seed. It is desirable to harvest, dry, and ship such seed as quickly as possible (e.g., within days). However, typical parent or commercial quantities of corn seed are dried in many batches, where each batch is a limited quantity of bushels of ear corn. The above-mentioned constraints on drying rate can many times require quite a few days of drying (e.g., 50-100 hours) to reduce typical 20%-40% moisture levels down to 10%-15% for each batch. More efficient but safe drying could shorten the time to dry each batch, and ready them for shipment. This can reduce shipping costs by allowing cheaper and slower shipping methods. Even with a plurality of multiple drying bin dryers operating simultaneously, safe drying, again, conflicts with efficient handling of such seed after harvest.

A typical approach to maintain reasonable control of drying in present parent and commercial seed corn drying is to periodically remove seed samples from the dryer during the drying process and measure the samples' moisture content. It is a direct measurement of current seed moisture content for samples. This allows an estimate of drying rate by comparing the measured values of moisture content over time. If the sampling reveals a substantial variance from a desired drying rate, the operator can attempt to make adjustments to the dryer to try to bring the drying rate back into line. However, the approach is resource intensive (labor and time), requiring careful physical removal of representative samples of drying ears from the bins or drying chambers, which is problematic as inaccuracies occur if the samples are not representative, some type of relatively rapid moisture measurement, and operator skill to make indicated dryer adjustments. The burden and overhead increases with frequency of sampling. It also presents accuracy issues. Practical sampling frequency (a reasonable length of time between samples) necessitates substantial interpolation to derive drying rate. Accurate sampling also requires accurate measurement of moisture content of the samples.

However, it has been found that conventional rapid methods of measuring moisture content in corn seed on the ear have significant variability. Even relatively small variability can have a material effect on accuracy of estimated drying rate. For example, a 1% error in a sample moisture measurement can result in a magnitude of error which may create a risk to seed quality and drying efficiency. As a general illustration, a correct 34% initial moisture measurement would translate to 86 hours of drying for a recommended 12.5% final moisture at a 4.0 hrs/pt drying rate. If, instead, an erroneous 33% initial moisture measurement was obtained from a sample with actual 34% moisture content, it would erroneously translate to 82 hours of drying time for the same goal of final moisture of 12.5% at a 4.0 hrs/pt drying rate. But to actually achieve 12.5% moisture in 82 hours would require a decrease in drying rate to 3.81 hrs/pt. As previously stated, rates below 4.0 hrs/pt may represent risk of damage to parent corn seed or its quality. Therefore, what would appear to be a direct measurement of drying, namely, actual sample moisture measurements during drying, introduces the risk of unacceptable or inefficient estimation and control of drying rates. This risk is over and above the resources needed to obtain samples and moisture measurements, including from multiple simultaneously-operating bins.

Another current dryer control approach is to utilize mathematical models to predict drying rate. For example, drying rate is sometimes calculated or predicted through the use of a statistical prediction model. These models try to simulate the performance of a dryer with computer programs based on equations that relate to the physics and physical chemistry of drying. However, these methods tend to have low accuracy and reliability, which affects the dryer's capacity and efficiency.

Thus, there is room for improvement relative to control over heated air seed drying, including more precise control over drying rate, so that risk of damage to the seed is reduced and efficiency of drying is improved. The dilemma is that for seed quality, drying rate cannot fall much below a standard, but for reasonable efficiency, drying rate cannot be substantially greater than the standard. There is thus a need for improved drying rate accuracy from the filling of a dryer bin or chamber until removal. There is also a need for efficiency in energy usage and harvest logistics. For example, significant savings in shipping costs per bin or batch could be realized by being able to ship by land or sea as opposed to by air freight. A reduction of drying time by a day or more might make such a difference.

Investigation of present seed drying processes has found that high variation in readings of sample moisture have variability that can effect seed quality and drying efficiency substantially. Therefore, a need exists for a better way to control drying than sampling moisture during drying or relying on mathematical models of drying. A need has also been identified to be able to estimate, within reasonable accuracy, drying rate, and seed moisture content anytime during the drying period without taking periodic samples from the bins.

Analogous issues can exist with other seed, and with other granular or particulate products.

BRIEF SUMMARY OF THE INVENTION

A method according to one aspect of the invention comprises monitoring dryer exhaust air temperature ("exhaust temperature") during heated air drying of a product. If exhaust temperature varies from a pre-determined target exhaust temperature reference, adjustment can be made to one or more drying factors to bring exhaust temperature back towards the reference. The target exhaust temperature reference is based on a correlation between a target drying rate and exhaust temperature. Control of exhaust temperature is, thus, control of drying rate, which can result in higher efficiency and throughput while staying within recommended drying parameters for the product.

In one aspect of the invention, the method of controlling drying comprises correlating percent seed moisture drop to increases in exhaust temperature, and using the correlation to control a drying process.

In another aspect of the invention, monitoring of exhaust temperature allows predictions related to drying rate and seed moisture at any time during drying. A known target drying rate that is correlated to exhaust temperature and a known initial product moisture content allows estimation of seed moisture and drying rate at any time during drying.

In another aspect of the invention, an apparatus or system comprises a particulate or granular product dryer having one or more drying chambers or bins, an air inlet, and an exhaust outlet is provided. The air inlet is operably connected to adjustable drying pressure and/or inlet air temperature components. A temperature sensor is operably positioned to measure and produce a signal representative of exhaust temperature of each bin. A device in communication with the exhaust temperature signal either provides an operator perceivable representation of measured exhaust temperature relative to a target or reference exhaust temperature, or automatically instructs adjustments to the drying pressure and/or inlet air temperature components in response to variation of the measured exhaust temperature to a target or reference exhaust temperature function correlated to a target drying rate.

BRIEF DESCRIPTION OF THE DRAWINGS

FIG. 12C is a single graph comparing the results of FIGS. 12A and B.

DETAILED DESCRIPTION

Figure 1:
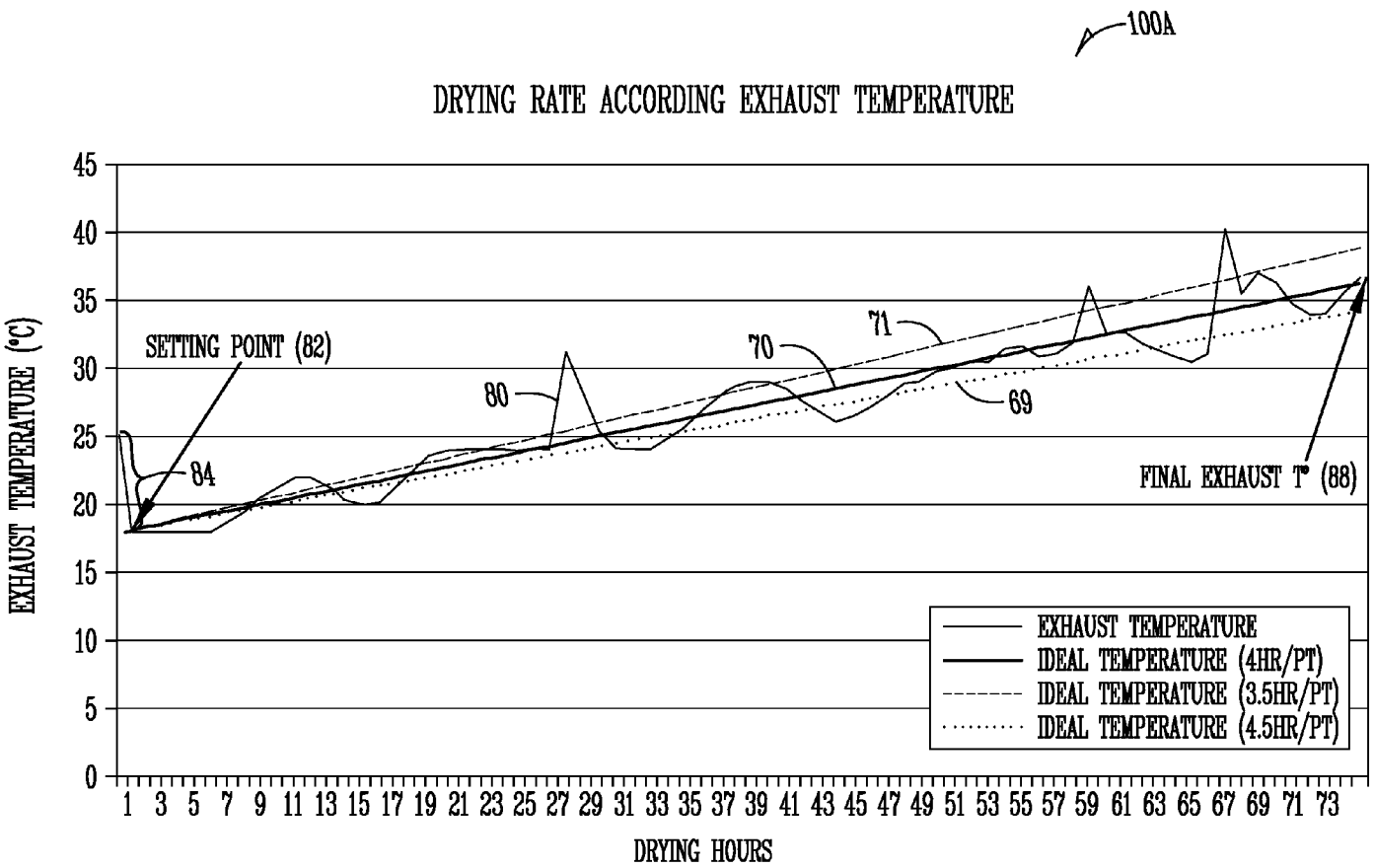
FIG. 1 is graph illustrating a control range for dryer bin exhaust air temperature according to one aspect.

For a better understanding, exemplary embodiments will now be described in detail. Reference will be taken from time to time to the drawings, which are identified by Figure number and are summarized above. Reference numerals or letters are used to indicate certain items or locations in the drawings. The same reference numbers or letters indicate the same or similar items or locations throughout the drawings unless otherwise indicated.

Figure 2:
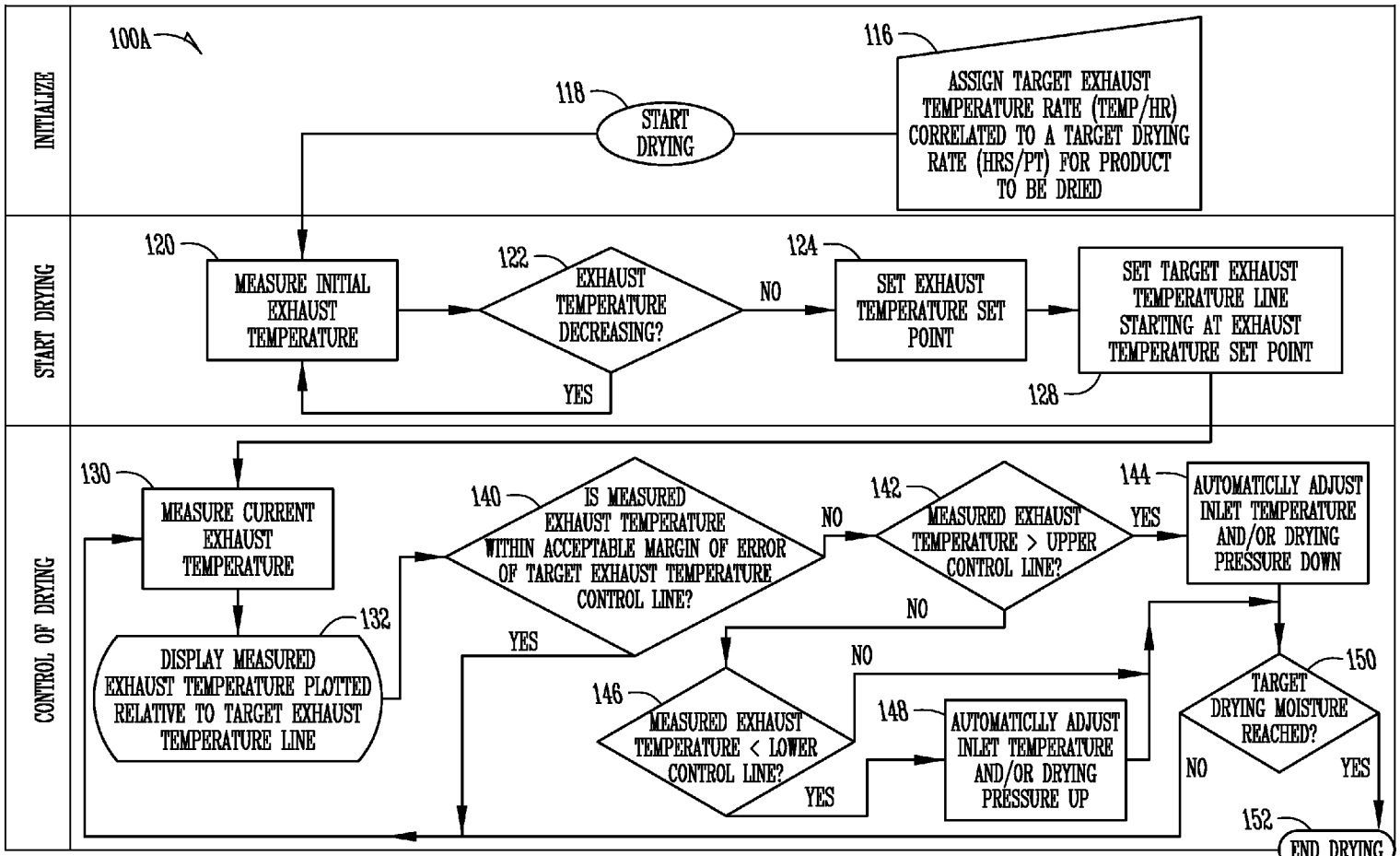
FIG. 2 is a flow chart of a method of dryer control according to the control range of FIG. 1.

General Method Exemplary Embodiment (Method 100A, FIGS. 1 and 2)

FIG. 1 illustrates the basic concept of a method 100A. FIG. 1 is a graphical representation of a target exhaust temperature rate or control line 70 for a product to be dried in a bin by a heated and pressurized air dryer, using corn seed on ears in this example. Upper and lower control lines 71 and 69 in FIG. 1 define a range of target exhaust temperatures on opposite sides of target control line 70 for the entire estimated drying time period for the product. In this example, the control lines are straight lines but, as can be seen in FIG. 1, which can have different slopes. Control lines 69, 70, and 71 provide a guide for a target temperature for the exhaust air from the dryer bin during drying. As will be discussed later, control line 70 has a correlation to a desired drying rate for the product.

Operation of the dryer to cause dryer exhaust temperature to follow control line 70 is the goal. During drying, temperature of exhaust air from a drying bin ("exhaust temperature" 80) is measured and plotted relative to control lines 69, 70, and 71, as shown in FIG. 1. If measured exhaust temperature trends away from control line 70, one or more drying factors for the dryer are adjusted in a manner to influence or bring exhaust temperature back to more closely follow control line 70.

The focus is on watching the behavior of exhaust air temperature from a drying bin. One way to implement the general method of FIG. 1 is by visual display of the control lines 69, 70, and 71 of FIG. 1 on a computer screen or control display for the dryer operator. The operator can select a bin, and a sensor in or at the exhaust of a selected bin can report bin exhaust temperature so that exhaust temperature can be plotted (line 80) relative to control lines 69, 70, and 71 as drying progresses. The operator therefore can have a visual presentation of the target exhaust temperature relative to accumulated drying hours essentially providing a target exhaust temperature rate for the entire drying period. Concurrently, the operator can have a visual presentation of measured actual exhaust temperature for that bin. The operator can visually compare the information and take action, as needed, to adjust the drying process to try to make bin exhaust temperature line 80 follow control line 70 as closely as possible.

The operator does not have to take seed samples from the bin. The visual representation of FIG. 1 can be continuously updated in essentially real time. Therefore, the operator has a way to consistently monitor a display of exhaust temperature and make appropriate adjustments. The benefit can be improved efficiency and less risk of damage to the seed by following more closely an ideal drying rate.

Because of the inherent operation of such heated air dryers, line 80 will likely be non-linear and have some excursions away from line 70 (in either direction). However, by having a pre-assigned control line 70, any detected trend of line 80 away from line 70 can be addressed by adjustment of a drying factor, such as the temperature of inlet air or the magnitude of drying pressure, in a manner intended to bring exhaust temperature to more closely follow line 70. As can be appreciated by those skilled in the art, the closer line 80 follows line 70, the closer to the target drying rate the drying process should be.

Target Exhaust Temperature Rate or Control Line(s)

FIG. 2 is a flow chart of a method 100A which can be practiced with the concept of FIG. 1 to control a drying process. It can be used to create a target exhaust temperature rate correlated to a target drying rate and a visual display for a dryer operator which presents a guide or target for dryer operation.

A target exhaust temperature rate (e.g. ratio of change in increase in exhaust temperature per unit time over a drying period) is assigned to the drying application (FIG. 2, step 116).

In this example of drying parent or commercial seed on the ear, the target exhaust temperature rate has been correlated with a target drying rate. Seed quality standards suggest a drying rate of 4.0 hours of drying per percent or point loss of moisture from the seed (4.0 hrs/pt). This is a constant rate and therefore, can be expressed as a straight line with a slope.

The absolute value of the slope of 4.0 hrs/pt has been correlated to the absolute value of the slope of average exhaust temperature rate for the same time unit time. For seed corn, it has been found that a target drying rate (4.0 hrs/pt) slope has a quite similar absolute value as the target exhaust temperature rate slope represented by line 70 in FIG. 1. Line 70 thus indicates a desirable theoretical exhaust temperature over a normal drying period to dry the seed at 4.0 hrs/pt. The slopes of drying rate and exhaust temperature generally are of opposite signs because drying relates to decrease in seed moisture content over time and exhaust temperature generally relates to increasing air temperature in the bin over time to maintain relatively constant drying rate.

Correlation of Exhaust Temperature to Target Drying Rate.

Correlation between a target drying rate of 4.0 hrs/pt for seed corn and target exhaust temperature control line 70 was derived as follows.

Figure 3:
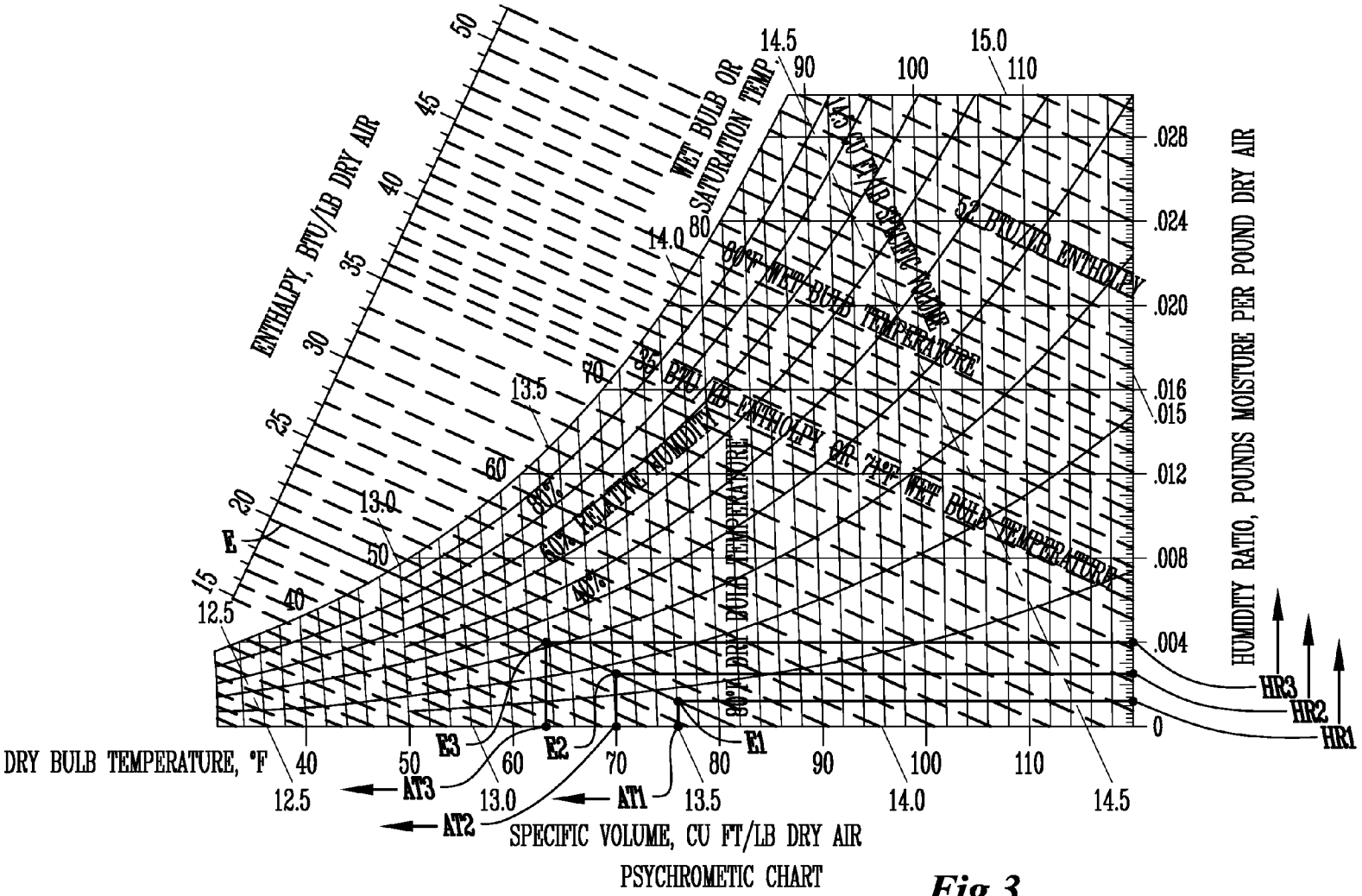
FIG. 3 is a published psychrometric chart illustrating thermodynamic properties of moist air.

1. Known psychrometric principles of the thermodynamic properties of moist air have established that as the water content of air increases, air temperature decreases. This is shown in the widely-published psychrometric chart of FIG. 3. As humidity ratios HR1, HR2, and HR3 (the amount of moisture in a unit volume of air) increase, air temperatures AT1, AT2, and AT3 decrease.

Figure 4:
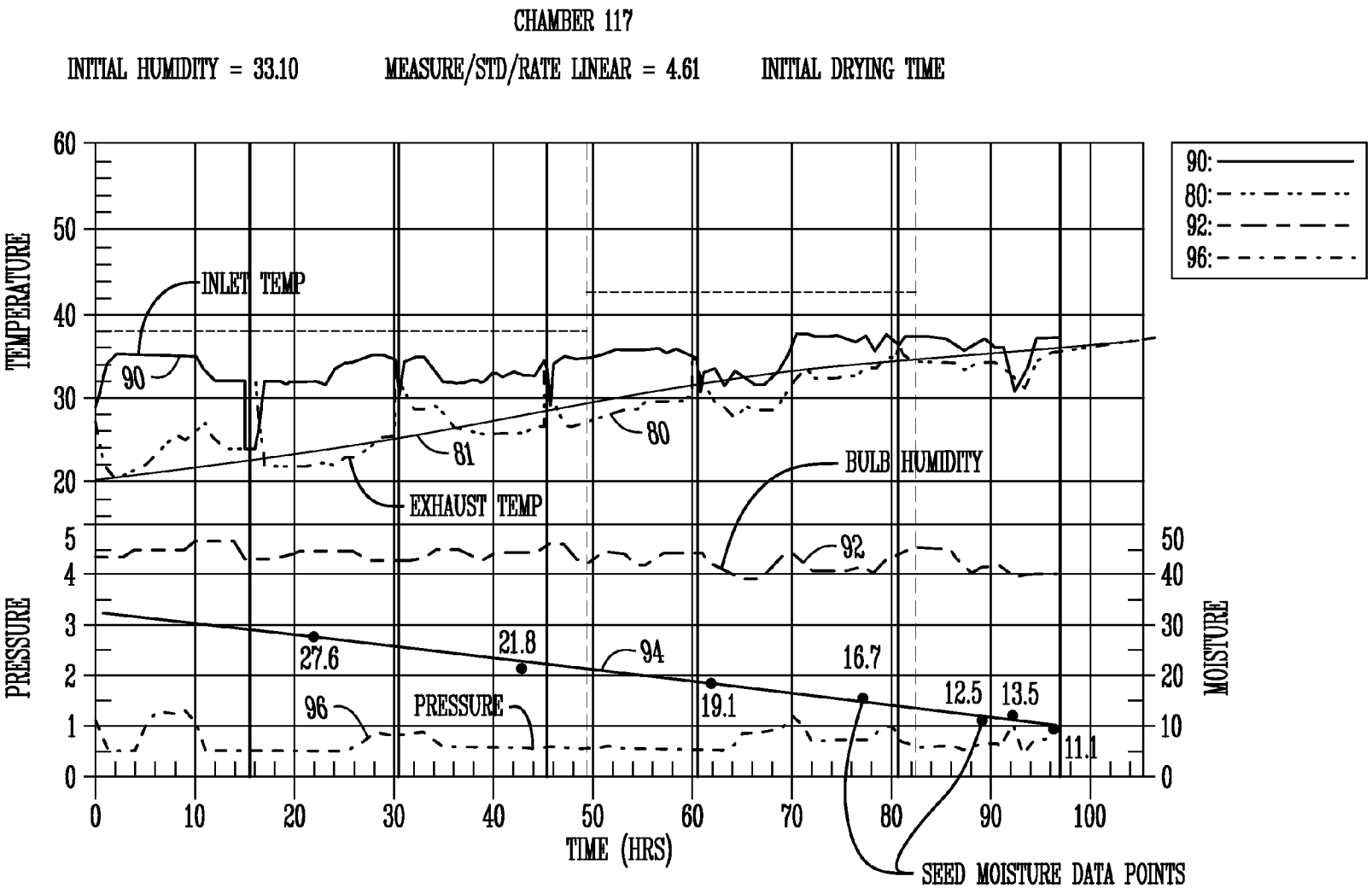
FIG. 4 is a graph illustrating a variety of measured drying process parameters obtained during testing of drying operation of a first dryer, with drying control by manual adjustment of drying factors by a dryer operator.
Figure 5:
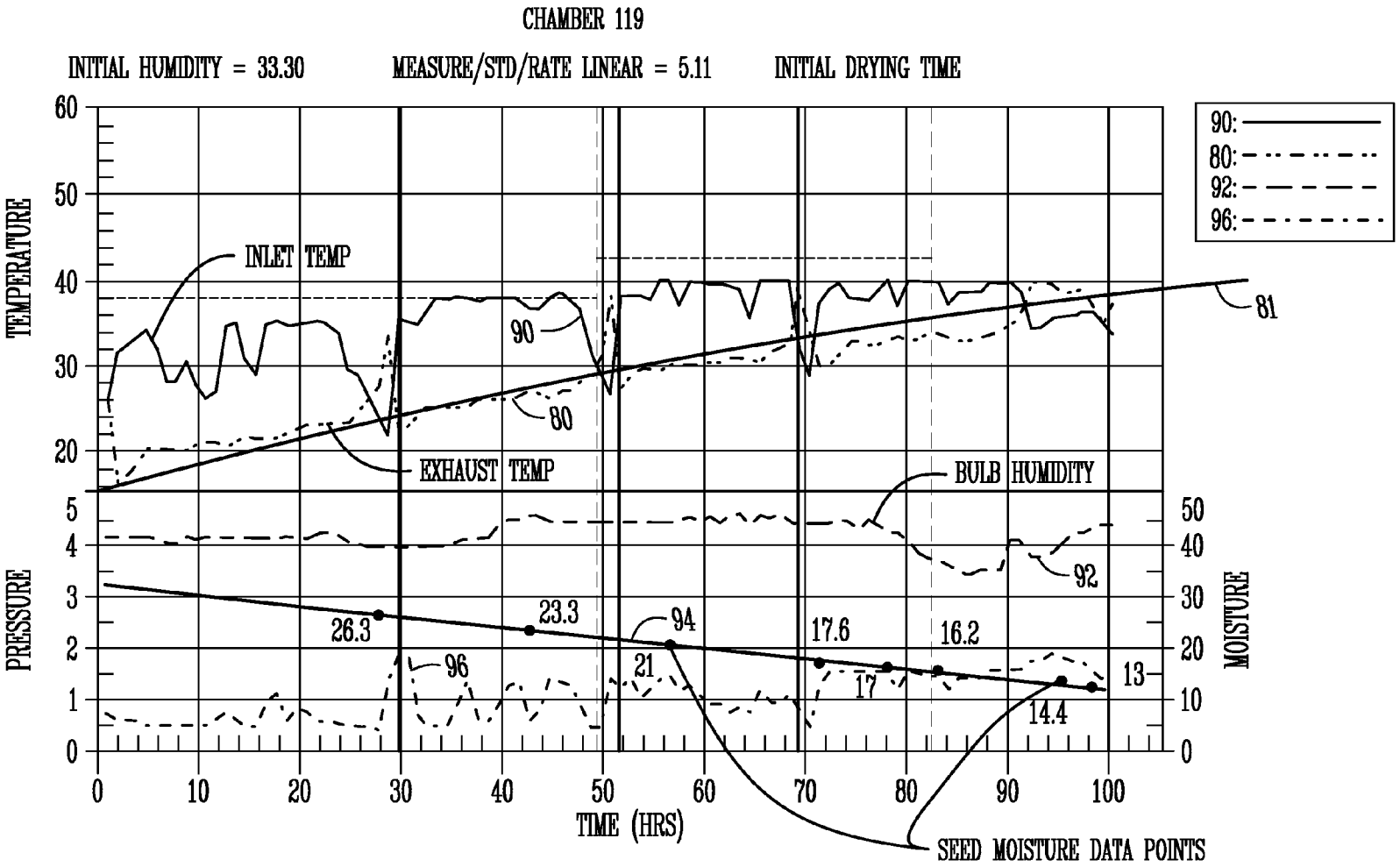
FIG. 5 is similar to FIG. 4 but illustrating the same measured drying process parameters during testing of drying operation of the first dryer with some automatic control of drying factors.
Figure 6:
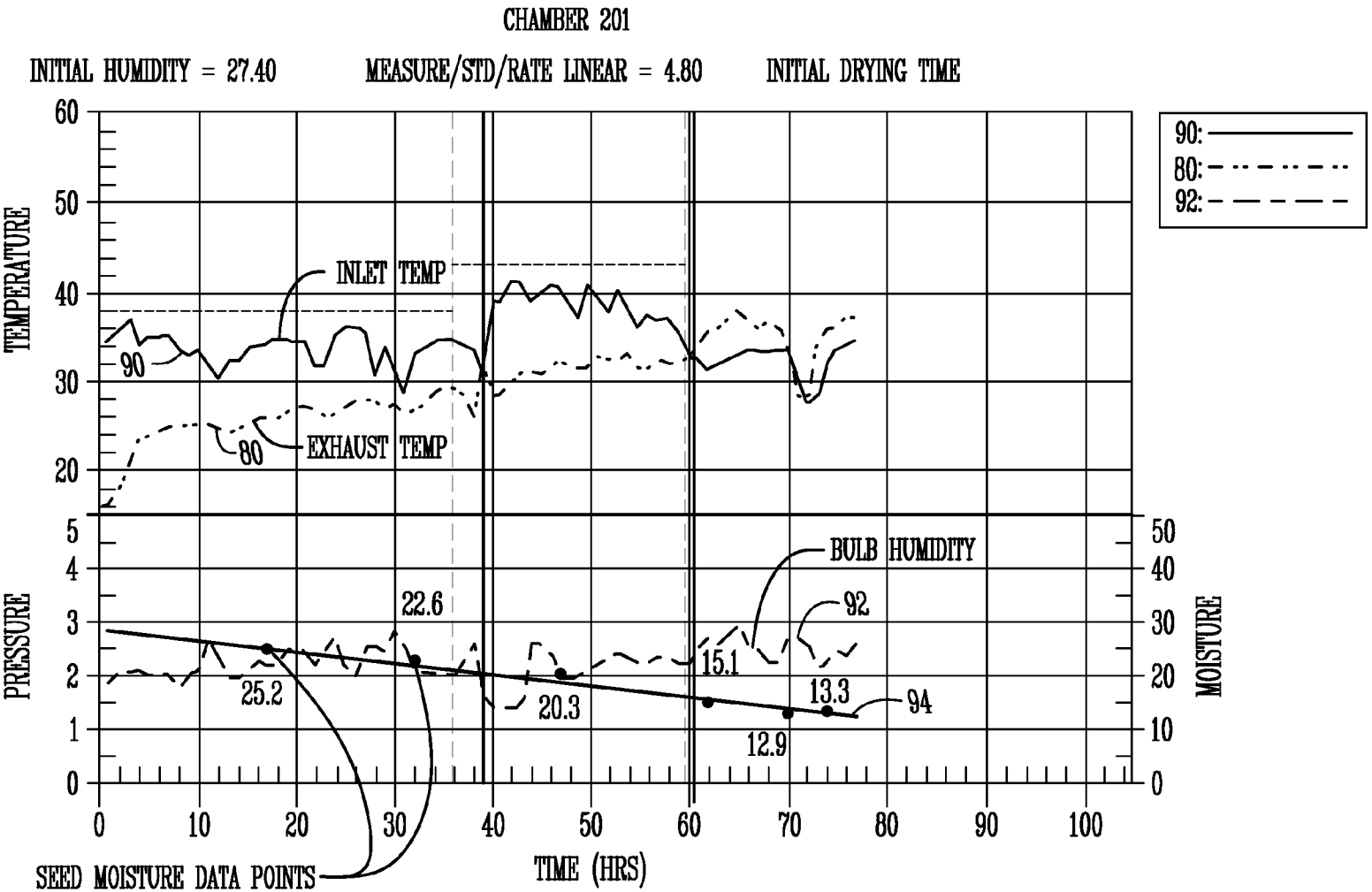
FIG. 6 is similar to FIG. 4, illustrating the same variety of measured drying process parameters, but during testing of drying operation of a second type of dryer.

2. During seed drying in which a number of parameters were monitored (e.g. inlet air temperature, exhaust air temperature, drying pressure, and humidity to a drying bin, and seed moisture from periodic testing of samples in the bin), it was observed that a relationship existed between (a) the behavior of a plot of measured exhaust temperature relative to drying hours and (b) the behavior of a plot of percent moisture decrease from periodic samples taken from the dryer over the same drying period. Examples of that testing are shown at FIGS. 4-6. As indicated in FIGS. 4-6, line 80 (through plotted exhaust temperature data points) is essentially the exhaust temperature rate 81 (change in exhaust air temperature over change in time). Line 94 through the plotted moisture content measurements of samples is essentially the drying rate (change in seed moisture level over change in time). Lines 80 and 94 have very similar slopes, in absolute value. In absolute terms, exhaust temperature increased at a relatively constant rate as moisture was removed from the seed in the drying chamber at a relatively constant rate. More specifically, FIGS. 4-6 illustrate that for a relatively constant reduction in seed moisture content over time, there is a relatively constant, similar increase in exhaust temperature (compare lines 94 and 80, respectively). Details about the testing of FIGS. 4 and 5 are set forth in Tables A and B below. Actual moisture measures of samples were taken and plotted (line 94). Line 94 represents a ratio of percent seed moisture decrease over hours of drying time (pts/hr). Drying rate is simply the inverse (hrs/pt). FIG. 4 is for a dryer of the type of U.S. Pat. No. 5,893,218 when drying was not automated (an operator manually controlled drying factors such as inlet air temperature and drying pressure relative to moisture measurements of samples). FIG. 5 is for the same type dryer, but when drying was semi-automated (a controller adjusted one or more drying factors based on moisture measurements of samples). FIG. 6 is for a dual pass type dryer. Each was operated to try to follow a drying rate of 4.0 hrs/pt. It can be seen that at least for FIGS. 4 and 5, inlet air temperature was the primary drying factor that was altered to adjust exhaust temperature. Thus, a target exhaust temperature rate may be assigned for at least a substantial portion of a drying period. The target exhaust temperature rate may be correlated to a target drying rate. Drying operation may then be adjusted such that exhaust temperature follows the target exhaust temperature rate.

TABLE A

| Details Regarding Test of FIG. 4 (for Bin 117) | |
|---|---|
| Material | Hybrid Seed corn Product 1 |
| Filling Depth (ft) | 7 |
| Filled Beginning (date/hour) | Day 1 Time 0 |
| Drying up air (date/hour) | Day 1 Time 1 |
| Drying down air (date/hour) | Day 1 Time 2 |
| Pred. Complete (date/hour) | |
| Drying up air (date/hour) | Day 2 Time 3 |
| Drying down air (date/hour) | Day 3 Time 4 |
| Drying up air (date/hour) | Day 3 Time 5 |
| Drying down air (date/hour) | Day 4 Time 6 |
| Extinguished drying (date/hour) | Day 5 Time 7 |
| Beginning grain hours (date/hour) | Day 5 Time 8 |
| Information re: Drying Hours | |
| Filling | 0.9 |
| Air above | 50.0 |
| Air below | 46.7 |
| Drying Hours total | 96.7 |
| % Up air | 51.7 |
| Wait/Stay | 2.7 |
| Grain | 0.2 |
| Drying Rate (hrs/pt) | 4.4 |
| Information re: Seed Moisture | |
| Initial (%) | 33.1 |
| Desired Reversal | 22.0 |
| Est. Reversal | 0.0 |
| Desired Shelling (%) | 12.5 |
| Shell Final Pred. 1 | 0.0 |
| Shell Final Pred. 2 | 0.0 |
| Grain (%) | 11.0 |

TABLE A-continued

| Details Regarding Test of FIG. 4 (for Bin 117) | | |
|---|---|---|
| Average Readings | Air Above | Air Below |
| Inlet (° C.) | 34.1 | 34.8 |
| Exit (° C.) | 28.3 | 29.6 |
| Bulb Humidity | 11.4 | 11.5 |
| Pressure (inches of water) | 0.8 | 0.7 |
| Index Information | Pred. | PM |
| Information Sample/Pattern/Model (Date/Hour) | Sample | |
| Day 1 Time 0 (% or pt) | 27.6 | |
| Day 2 Time 1 (% or pt) | 21.8 | |
| Day 2 Time 2 (% or pt) | 19.1 | |
| Day 3 Time 3 (% or pt) | 16.7 | |
| Day 3 Time 4 (% or pt) | 12.5 | |
| Day 4 Time 5 (% or pt) | 13.5 | |
| Day 4 Time 6 (% or pt) | 11.1 | |

TABLE B

| INFORMATION RE BIN 119 | |
|---|---|
| Material | Hybrid seed corn Product 2 |
| Filling Depth (ft) | 8 |
| Filled Beginning (date/hour) | Day 1 Time 0 |
| Drying up air (date/hour) | Day 1 Time 1 |
| Drying down air (date/hour) | Day 2 Time 2 |
| Pred. Complete (date/hour) | |
| Drying up air (date/hour) | Day 3 Time 3 |
| Drying down air (date/hour) | Day 4 Time 4 |
| Extinguished drying (date/hour) | Day 5 Time 5 |
| Beginning grain (date/hour) | Day 5 Time 6 |
| Information Hours | |
| Filling | 3.3 |
| Air above | 46.4 |
| Air below | 53.9 |
| Hours total | 100.3 |
| % Up air | 46.3 |
| Wait/Stay | 0.2 |
| Grain | 0.8 |
| Drying Rate (pts/hr) | 4.6 |
| Information Moisture | |
| Initial (% or pt) | 33.3 |
| Desired Reversal (% or pt) | 22.0 |
| Est. Reversal (% or pt) | 0.0 |
| Desired Shelling (% or pt) | 12.5 |
| Shell Final Pred. 1 | 0.0 |
| Shell Final Pred. 2 | 0.0 |
| Grain (% or pt) | 11.7 |

| Average Readings | Air Above/ | Air Below |
|---|---|---|
| Inlet (° C.) | 33.9 | 36.9 |
| Exit (° C.) | 25.2 | 31.5 |
| Bulb Humidity | 10.8 | 10.3 |
| Pressure (inches of water) | 0.8 | 1.3 |
| Index Information | Pred. | PM |
| Information Sample/Pattern/Model (Date/Hour) | Sample | |
| Day 1 Time 0 (%) | 26.3 | |
| Day 2 Time 1 (%) | 23.3 | |
| Day 2 Time 2 (%) | 21.0 | |
| Day 3 Time 3 (%) | 17.6 | |
| Day 3 Time 4 (%) | 17.0 | |

TABLE B-continued

| INFORMATION RE BIN 119 | |
|---|---|
| Day 3 Time 5 (%) | 16.2 |
| Day 4 Time 6 (%) | 14.4 |
| Day 4 Time 7 (%) | 13.0 |

3. The observed relationship of exhaust temperature and drying rate (see FIGS. 4-6), and the psichrometic relationships of FIG. 3, suggested that the temperature of exhaust air should indicate its water content, as the process of drying involves water passing from the seed to the air. Thus, over time, a relationship should exist between exhaust air water content and drying rate (ratio of time to reduce moisture content in the seed by 1%).

4. The empirical testing of the type illustrated in FIGS. 4-6 found that for several different dryer types (e.g. single pass and double pass) and different batches of seed corn, the following relationship existed: exhaust temperature increases approximately 1° C. (1.8° F.) for every 1.1% (1.1 pt) drop in seed moisture. The similar but opposite slopes of increasing exhaust temperature per unit time and decreasing moisture per unit time essentially was found to have a 1 to 1.1 relationship (approximately 1 to 1). A rate of change of 1.1 pt per 4.0 drying hours is approximately a negative 0.25 pt/hr slope. Applying the similar slope of drying rate to exhaust temperature (but of opposite sign), exhaust temperature can be graphically represented relative to drying hours with a 0.25° C./hr slope.

Figure 7:
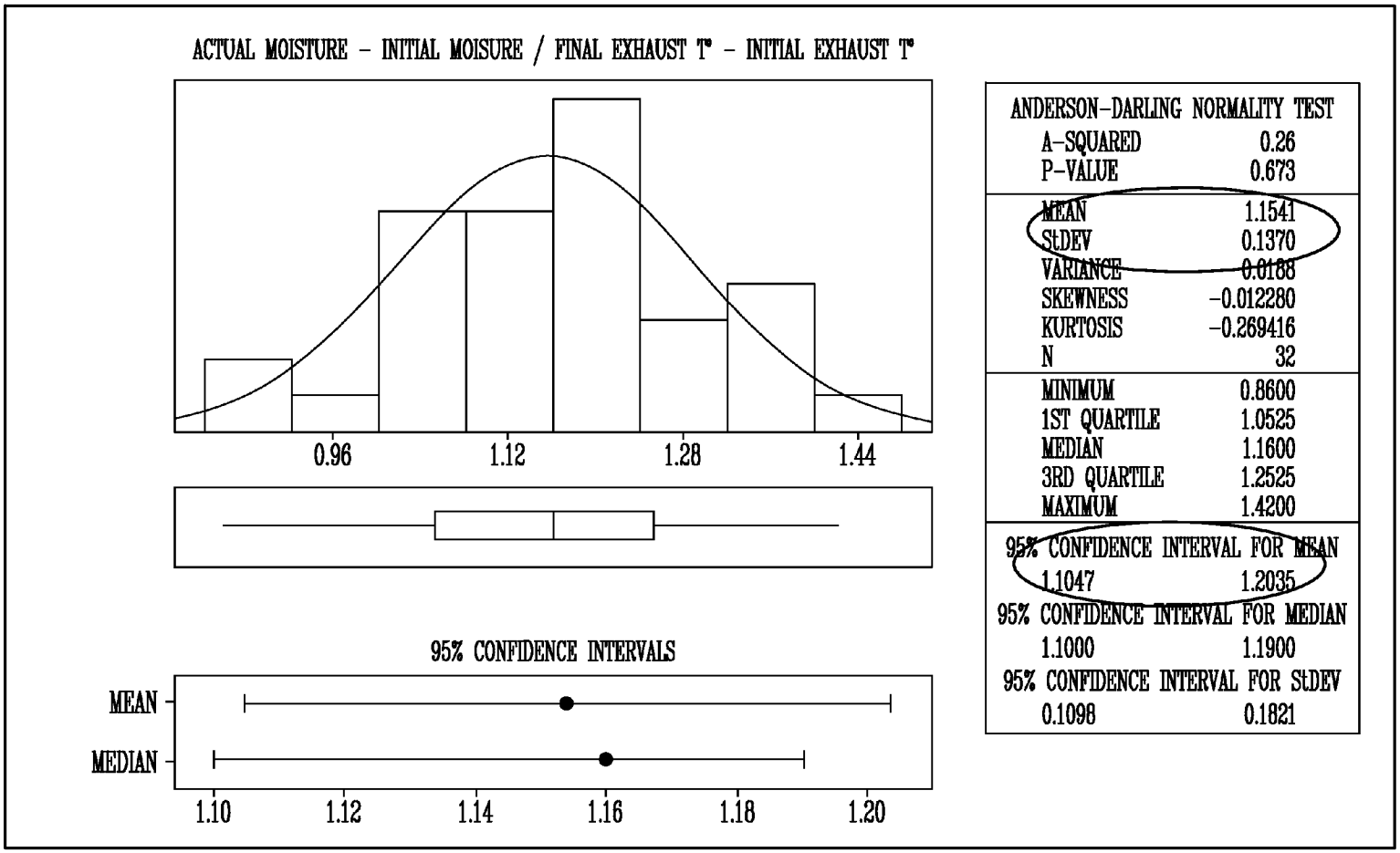
FIG. 7 is a graphical representation of correlation between exhaust temperature and seed moisture drying over time.

5. Testing has demonstrated a good statistical relationship between exhaust temperature and drying rate. FIG. 7 illustrates this relationship based on calculations of the following ratio of measurements: (actual moisture−initial moisture)/(final exhaust temp−initial exhaust temp). This ratio relates to total seasonal drying rate or total drying rate of the bin when defined as: total drying hours/(initial drying moisture−final shelling moisture). The mean is 1.1541 with a standard deviation of 0.1370.

Thus, the above-described relationship between drying rate and exhaust temperature allows control line 70 to be assigned as the target for exhaust temperature for a bin of ear corn during drying from an initial moisture content to a target moisture content, as indicated in method 100A of FIG. 2. Control of exhaust temperature to control drying rate is based on the following concepts.

It is well-known that heated air drying rate for ear corn is generally a function of the following drying factors: (a) seed moisture, (b) inlet air temperature, (c) drying pressure, (d) bin filling depth, and (e) seed set. The latter two are considered secondary in importance. But the observation of the relationship of exhaust temperature to drying rate indicates exhaust temperature can be an indicator of drying rate. Because exhaust temperature through time has been shown to be a function of water content of the air through time, and drying rate is a function of water content of air through time, manipulation of exhaust temperature is a manipulation of drying rate.

As exhaust temperature indicates the behavior of drying, modification of drying factors to reach desired exhaust temperature allows drying rate control at any time during drying. Adjusting one or more drying factors, particularly the main factors of inlet air temperature and/or drying pressure can manipulate the drying rate. Therefore, exhaust temperature can likewise be manipulated by adjustment of one or more drying factors, e.g. inlet air temperature and/or drying pressure. Exhaust temperature control is, therefore, drying rate control at any time. This reduces the influence of secondary factors like filling depth, hybrid type, or seed set (the ratio of seed per ear). Furthermore, knowing changes through time of exhaust temperature allows estimation of how much seed water is being lost and, thus, estimation of drying rate and seed moisture at any time during drying.

Upper and Lower Control Lines

Once target or control line 70 is set, upper and lower control lines 69 and 71 can be set, if desired, to present a range of target exhaust temperatures. In this example, control lines 69 and 71 are straight lines with slightly different slopes related to line 70 as follows:

| Control line | Slope | Based on drying rate of: |
|---|---|---|
| Lower line 69 | 0.22 | 4.5 hrs/pt |
| Target line 70 | 0.25 | 4.0 hrs/pt |
| Upper line 71 | 0.28 | 3.5 hrs/pt |

The three control lines are established based on (a) a desired drying rate, (b) and/or a reasonable margin of error from that rate (here +/−0.5 hrs/pt). Drying of this nature is related to a number of drying factors. Operation of dryers of this scale is complex. Different bins may contain corn of different moisture content and other characteristics. Raising and lowering drying rate cannot be instantaneous. Therefore, the control lines provide an operator or automated program a reasonable target range to follow over time.

Other target rates for control lines and ranges can be selected, of course, depending on need or desire. Upper and lower lines 69 and 71 can vary from line 70 by the same or differing amounts. For example, some drying processes may have a greater acceptable lower limit margin of error, or vice versa.

Beginning Drying

After assignment of control line 70 and lines 69 and/or 71, if used, the drying process can be started (FIG. 2 step 118). Initial drying factor values can be set. In this example, an initial inlet air temperature and an initial drying pressure are selected. In the examples of FIGS. 4-6, inlet air temperature was the primary drying factor adjusted to control exhaust temperature. Drying pressure is a secondary controllable drying factor.

Inlet air temperature can be set to a reasonable level, but below the maximum. As will be discussed later, inlet temperature can be initially set based on initial seed moisture level.

Drying pressure can be initially set to what is considered a "medium" value (e.g. 0.5-1.0 inches of water) for a dryer of the type of U.S. Pat. No. 5,893,218 or for a dual pass type dryer. It can be manually or automatically modified during drying depending on exhaust temperature behavior. But, importantly, even if drying pressure is a secondary factor in method 100A, it can become a primary factor. For example, if a situation arises where increasing inlet temperature is not allowed (e.g., because of a maximum allowed drying air temperature limit), controlling drying pressure becomes a more relevant way to control the drying rate. It can be the exclusive method.

Set Point For Control Lines

It has been found beneficial to wait to set the starting point of control lines 69, 70, and 71 until the dryer bin "stabilizes". Stabilization means that exhaust temperature exhibits characteristics which are indicative that no free water is present in the drying bin. In this example, stabilization is assumed to have occurred when measured exhaust temperature for a new drying period has (a) stopped decreasing and starts going up or (b) has been steady for more than one hour (e.g., 2 hours). Other methods of estimating stabilization or designating the setting point are possible.

This "setting point" is illustrated graphically at reference number 82 in FIG. 1. Control lines 69, 70, and 71 are set to originate at the setting point 82. The exhaust temperature target range represented by lines 69, 70, and 71 may originate shortly after the drying process commences (e.g., when heated, pressurized air is first introduced to a bin including a batch of ear corn), but a time (usually relatively short) after drying commences—when the moisture content of the air in the bin is stabilized (see FIG. 2, steps 120, 122, 124, and 128). Setting point 82 normally will be only a few hours after commencement of drying in the bin. The change in the exhaust temperature 80 between commencement of drying in the bin and reaching the setting point 82 is illustrated graphically at reference number 84 in FIG. 1.

Since the slopes of control lines 69, 70, and 71 are known or set and constant, once the setting point is determined, a target exhaust temperature line or range is set for the remainder of a foreseeable drying period. This allows several estimations to be made that can be valuable to the drying process.

Final Exhaust Temperature

One estimation is "final exhaust temperature", as illustrated at reference number 88 in FIG. 1. Once setting point 82 is determined, if initial and final target seed moistures are known, an estimate of what the exhaust temperature should be when target seed moisture is reached is by a straight-forward calculation, as shown be the following example:

If:

Initial Moisture=30.9%

Target Moisture (final)=12.5%

Target Drying Rate=4 hrs/pt

Setting point exhaust temperature=18° C. (86° F.)

Then:

Differential moisture between Initial and Target Moisture=18.4%

Exhaust Temperature increment=16.7° C. between initial and final (based on 1.1% moisture loss every 1° C. increase)

Theoretical drying time=73.6 hr

And then:

Final Theoretical Exhaust Temperature=Setting Point Temperature+Exhaust Temperature Increment=18° C.+16.7° C.=34.7° C.

If a maximum allowed drying air temperature exists for the product being dried, this calculation can predict whether or not it may be violated at the end of drying. If so, drying pressure might be adjusted, instead of or in combination with air temperature increases, to maintain exhaust temperature to follow control line 70 late in the drying period.

Set Initial Inlet Air Temperature

Many seed quality plans have a maximum allowable drying temperature (e.g. maximum drying or inlet air temperature in the bin and/or maximum allowable seed temperature). It has been observed that care needs to be taken in setting initial inlet air temperature not only because of the maximum allowed air temperature guideline (the inlet temperature should be below the maximum from the start), but also to try to prevent it exceeding the maximum at any time, including at or near end of the drying period.

As moisture moves from the seed to the air during drying, air temperature tends to decrease. Therefore, most times air temperature must be continually increased over the drying period to accept more moisture. As illustrated in FIGS. 4-6, inlet air temperature tends to increase between the set point and the end of drying (it also tends to converge towards exhaust temperature). Therefore, an initial air temperature should be selected low enough to permit temperature increases over time without the final air temperatures exceeding the maximum allowed drying air temperature.

In other words, these quality plans restrict the temperature to which the seed can be exposed throughout the drying process. It is not permissible under these plans to use extreme temperatures to speed up drying time. If a constant drying rate is to used, this also means that care must be taken to avoid reaching a maximum drying temperature before drying to a desired level is achieved. As described above, by setting the target exhaust temperature control line 70 at the setting point 82, theoretical exhaust temperature for any time over the drying period can be estimated and compared to maximum allowed. Initial inlet air temperature can be set to a value that will allow it to increase, but not so much that before end of the drying time it, or exhaust temperature, will likely exceed maximum allowed.

As discussed above, the "final exhaust temperature" 88 can be calculated because of advance knowledge that target exhaust temperature changes at a rate of line 70. Advance knowledge of initial moisture content of the seed to be dried allows calculation of the number of theoretical drying hours to reach a final target seed moisture. A theoretical final exhaust temperature 88 can be derived by finding the theoretical exhaust temperature value corresponding to the theoretical drying hours to reach final target moisture.

The comparison may require an adjustment in initial inlet temperature and/or an adjustment in air flow (pressure) to keep air temperature within an allowed range. For seed corn, two initial inlet air temperatures, but not limited to, are recommended:

30° C. (86° F.) for Initial Moistures≤34%

25° C. (77° F.) for Initial Moistures>34%

These have been determined to likely allow enough temperature range at the end of the drying period to keep air temperatures below limit. As can be seen in FIGS. 4-6, for example, inlet air temperature and exhaust air temperature tend to converge towards the end of the drying period. Therefore, calculating final exhaust temperature can be used to relate final inlet temperature and initial inlet temperature, and select initial air temperatures low enough. By selecting several options, one for lower Initial Moistures and one for higher Initial Moisture seed, the program can handle a range of initial moisture levels, and be prepared for high moisture (>34%) corn.

There can be situations where inlet or exhaust temperature might exceed maximums. For dryers that allow the temperature to exceed a maximum, no further raises to inlet temperature would be allowed or used, and exhaust temperature would be controlled by control of some other drying factor, such as drying pressure.

Therefore, initial inlet air temperature is set proportionally to initial seed moisture. It can be set to the lowest possible level when drying is started. This allows a wider differential to current inlet air temperature and maximum drying air temperature and more efficient control of exhaust temperature.

Estimation of Total Drying Hours

Total drying hours (the estimated drying period) for the bin can be estimated. Knowing the target drying rate and final target seed moisture, one simply finds the point on line 70 when seed moisture will reach the final target moisture, and find the corresponding hours on the x-axis. The hours value at the setting point would be subtracted, and the remainder would be total estimated drying hours to achieve target final seed moisture assuming the target exhaust temperature is maintained in the bin.

Dryer Control by Exhaust Temperature During Remainder of Drying Period

After setting point 82 has set the control lines, dryer operation proceeds. Exhaust temperature is measured (FIG. 2, step 130) and plotted (see line 80 of FIG. 1). The operator can use one or more of the three control lines 69, 70, and 71 (e.g. displayed on a computer screen, FIG. 2, step 132) as a guide during the drying period, and can visualize the exhaust temperature response. The operator can modify one or more drying factors, such as inlet temperature and drying pressure (as is/are possible) and maintain exhaust temperature line 80 as close to line 70 as possible. Thus, by just monitoring one drying parameter, here exhaust temperature, the operator can control drying behavior. The operator is given real-time feed back of exhaust temperature and can make appropriate changes. The three control lines are not required, but provide a visual indication of acceptable margin of error to further assist the operator.

As indicated in FIG. 1, manual control of drying factors, such as inlet temperature and drying pressure, usually would result in an exhaust temperature 80 response that varies from the line 70, and sometimes goes outside the upper and lower control lines 71 and 69. The operator monitors line 80. As long as it stays reasonably within the range of upper and lower limit lines 71 and 69 (or is not trending sharply towards either limit), no drying factor changes are made (FIG. 2, step 140). However, if line 80 goes above upper limit 71 (step 142) or below lower limit 69 (step 146), the operator can make drying factor adjustments (e.g. lower or raise the inlet air temperature) (step 144 or 148) to influence exhaust temperature back within range. When a predicted final exhaust temperature 88 is reached (indicative of reaching target final seed moisture, step 150), the drying period is ended (step 152) and the seed removed. But until the drying period is ended, the operator would continue to monitor exhaust temperature 80 versus the target exhaust temperature control line 70 and adjust one or more drying factors to influence line 80 to follow line 70 (continually repeat steps 130, 132, 140, 142, 144, 146, 148 and 150).

FIG. 1 illustrates a typical set of guide lines 69, 70, and 71, as well as a representative example of an exhaust temperature curve 80 over an entire drying period. While curve 80 does not follow line 70 precisely, or even always stay within upper and lower limits 69 and 71, it reasonably follows line 70 between "setting point" 82 and a "final exhaust temperature" 88. The goal in the example of FIG. 1 is that exhaust temperature line 80 reasonably follows control line 70. This provides a straight-forward, relatively easy and accurate way of controlling drying. There may be divergences from the control line 70 outside the margin of error lines 69/71, but the operator could adjust drying factors to quickly bring the exhaust temperature back within range.

Summary

Using this exhaust temperature correlation to drying rate, a control guide can be presented to the operator to assist either manual or automatic control of at least one drying factor to keep exhaust temperature within or close to a target tolerance range. This promotes accuracy of drying rate to deter seed damage, while at the same time promotes more efficient drying for higher throughput.

Method 100A monitors and adjusts exhaust temperature to control drying. It provides a direct metric to do so. As a result, at least the following are possible:

(a) improved drying rate control in a variety of dryer types and for a variety of environmental or seed conditions.

(b) improved efficiency of drying (less hours per point moisture removed).

(c) more reliable and accurate control for safety and seed quality.

(d) decreased risk of drying damage because of accurate estimated drying rate at any time during drying period.

(e) a mean drying rate at or close to a target drying rate, or at least with reduced variation.

(f) a better estimate of drying rate and seed moisture any time during drying for every bin.

(g) improved handling of a range of initial seed moisture levels (including relatively high seed moisture substantially greater than 30%).

(h) higher efficiency due to savings in terms of use of dryers, harvest logistics and/or seed shipping (efficiency is improved in terms of at least less energy use, quicker drying, and therefore savings in money and time).

(i) application to a variety of drying methods and dryers.

(j) uses air temperature and drying pressure adjustment as primary drying factors.

(k) eliminates sampling.

Estimation of Product Moisture and/or Drying Rate During Drying

Estimation of drying rate and moisture at any time during conventional state-of-the-art drying methods is difficult. Knowing these parameters would allow an operator or automated program to tell, in essentially real time, if drying was proceeding well or not, and if not, corrective action could be immediately taken.

From Exhaust Temperature Control Line

Final seed moisture, as well as seed moisture at any time during drying can be estimated by simple calculations. If initial moisture and target drying rate are known, product moisture at any time during drying can be estimated by noting the accumulated drying hours associated with the particular time along exhaust temperature line plot 80, and calculating how much moisture would be lost from initial moisture for that amount of time at the target drying rate.

Similarly, if initial moisture and a target drying rate are known, actual drying rate at any time during drying can be estimated by evaluating actual exhaust temperature curve 80 at and around that time of drying. Using conventional techniques, the slope of curve 80 can be derived to inform the operator of an estimated drying rate at or around that time.

From Energy Model

Figure 8A:
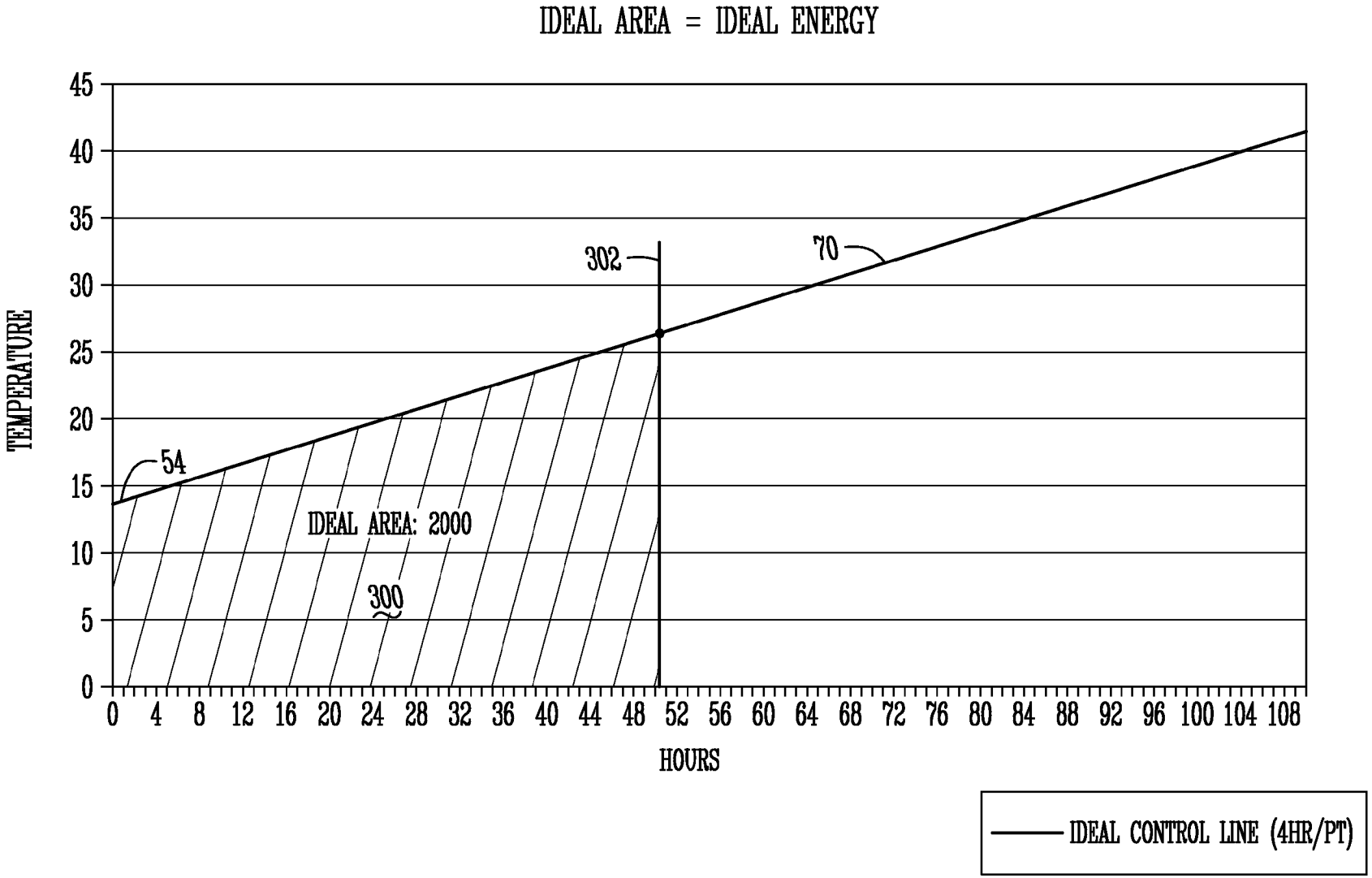
FIGS. 8A-C are graphical illustrations of a method to predict seed moisture and drying rate at any time during a drying period using a drying method similar to FIGS. 1 and 2.
Figure 8B:
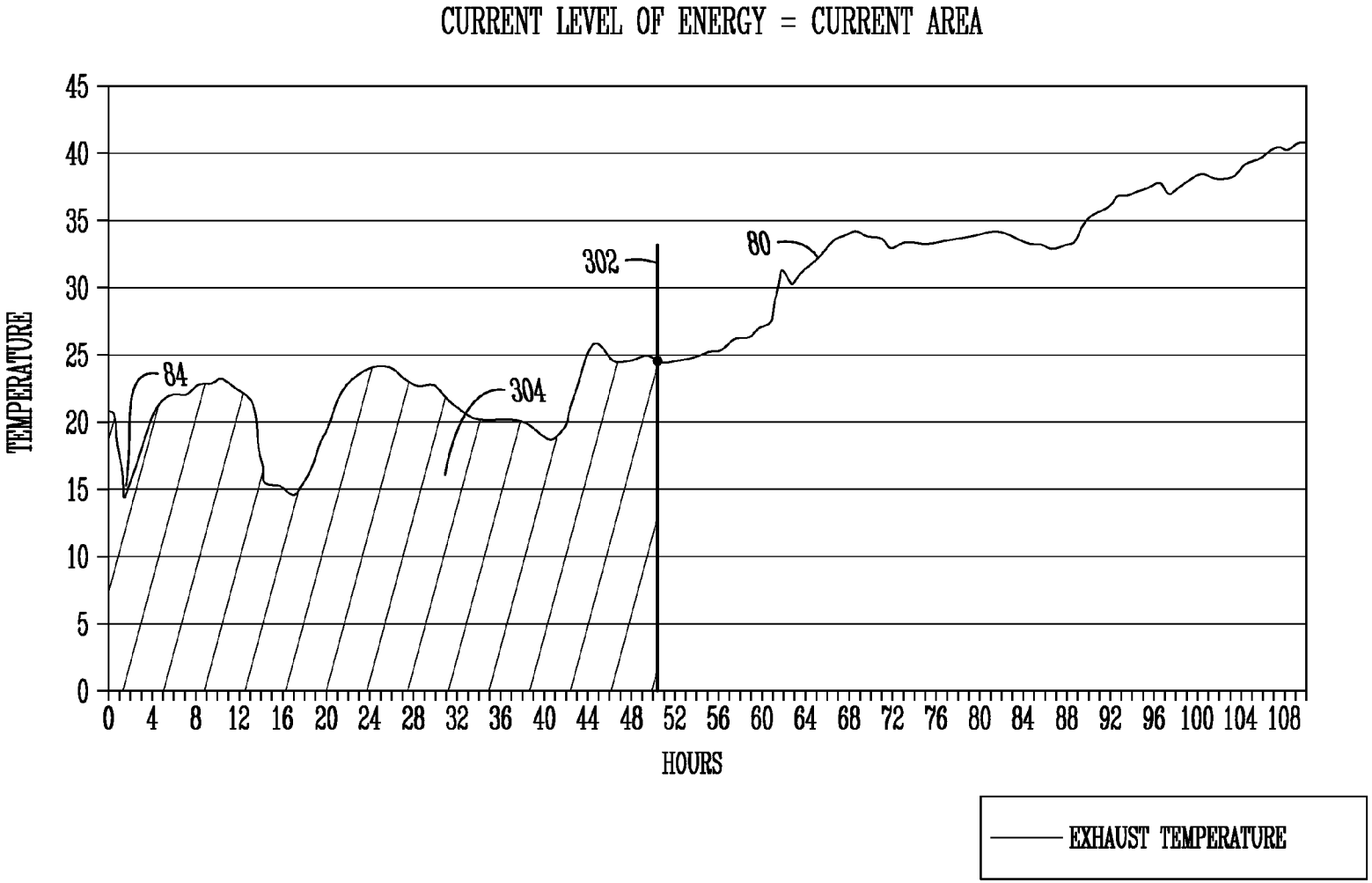
Figure 8C:
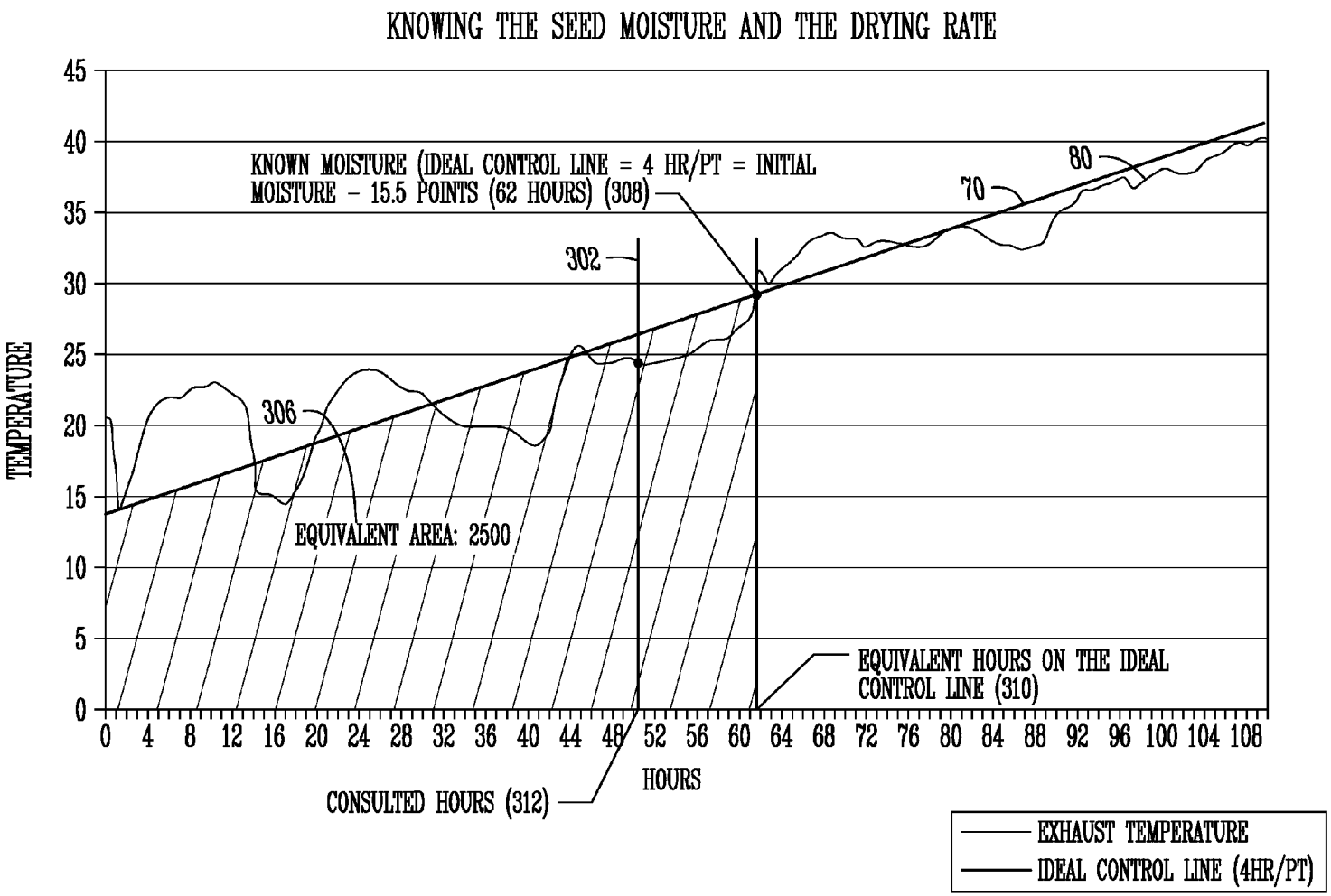

Alternatively, what will be called an energy model can be used to estimate seed moisture and drying rate at any time during drying. FIGS. 8A-C illustrate such an alternative approach. This model would be particularly valuable with double-pass type dryers, with which drying air temperature and pressure are hard to control, and thus exhaust air temperature is hard to control.

Heat is a form of energy. As drying air is heated, energy is used. Change in temperature indicates a change in energy applied. Control line 70, according to method 100A, can also be considered a determination of energy required in every hour of drying.

As illustrated in FIG. 8A, integration of line 70 produces an area under line 70 called "Target Area"; with setting point 82 and final exhaust temperature point 88 as limits. Target Area is a representation of heat energy needed to dry the product to that point in time (i.e. Target, Expected, or Estimated Energy).

FIG. 8B illustrates an integration of the area under exhaust temperature line 80, called "Current Area", with the same limits as Area. Current Area is a representation of heat energy that has actually been used to dry the product to that same point in time (i.e. Current Energy). If Target Energy is compared to Current Energy applied, an estimation of current seed moisture and drying rate are possible for any instant of the drying period. Since heated exhaust air is a kind of energy, changes in Exhaust Temperature can be understood as changes in energy applied.

A specific example is as follows. Control line 70 is set for the bin and the seed being dried. The slope of line 70 is determined based on desired target drying rate (4.0 hrs/pt) (see FIG. 8A). After setting point 82 is determined, control line 70 is set relative to the foreseeable drying hours. Drying proceeds according to method 100A. The operator controls inlet air temperature to attempt to make actual exhaust temperature 80 follow control line 70 by a comparison of ideal exhaust temperature line 70 to real exhaust temperature line 80. At any time during drying, in this example at 50 hours of accumulated drying time (the "Consulted Hour"), an estimation of seed moisture and/or drying rate can be made:

1. Target Energy can be represented by the integral of the Target Temperature Line 70 from setting point 82 to the point along line 70 that corresponds to a Consulted Hour of 50 hours (see Target Area 300 at FIG. 8A). When Target Temperature line 70 is calculated, the energy required for drying the seed is determined (Target Energy). Target Energy is an index (without units) of exhaust air energy needed in every hour to maintain a target drying rate to Consulted Drying Hour 302. In this example the integrated area or Target Area index value is 2000 for the Consulted hour 302.

2. Current Energy can be represented by the integral of the actual measured exhaust temperature curve 80 between setting point 82 and Consulted Hour 302 (see Current Area 304 at FIG. 8B). Current Energy is an index (without units) of exhaust air energy used up to the Consulted Hour. In this example the integrated area or Current Area index value is 2500.

3. What is called "Equivalent Area" is represented by the area 306 underneath the Target Line 70 in FIG. 8C. Area 306 is derived as follows. A comparison is made of the Target Area index and Current Area index. The hour that both indexes are equal is called the Equivalent Hour. Stated differently, Equivalent Area 306 is a plot of Current Area relative to control line 70 rather than exhaust temperature line 80. As can be seen, Current Area index of 2500 is larger than Target Area index of 2000. When the larger index area of 2500 is plotted under line 70 (FIG. 8C), it extends farther to the right (past Consulted Hour 302) than Area index of 2000 of FIG. 8A. If Current Area index were smaller than Target Area index, Equivalent Area would not reach Consulted Hour 302.

4. "Equivalent Hours" is the point 308 along line 70 of FIG. 8C that corresponds to the value (reference number 310) along the x-axis value (here Equivalent Hours on the Target Control Line 70 is 62 hours).

5. Current or Known Moisture can then be estimated by using the following: (Initial Moisture)−(Equivalent Hours/Target Drying Rate). This determines what Moisture is at the Equivalent Hour on the Target Exhaust Temperature Line 70. This Target Moisture corresponds to the moisture of the Consulted Hour. For example, for an Initial Moisture of 30% and a Target Drying Rate of 4.0 hrs/pt, Current Moisture is therefore (30%)−(62 hrs/4.0 hrs/1%)=(30%)−(62 hrs×1%/4.0 hrs/%)=(30%)−(62%/4%)=30%-15.5%=14.5% (at consulted hour).

6. Current Drying Rate at the Consulted Hour can then be estimated by: Consulted Hour/(Initial moisture−Current moisture), where current moisture is calculated as above. Therefore, in this example, Current Drying Rate=50 hrs/(30%−14.5%)=50 hrs/15.5%=approx. 3 hrs/pt.

Accuracy of estimating Current Moisture and Current Drying Rate in this way depends substantially on reliability and accuracy of the exhaust temperature measurements used to create curve 80, and the reliability and accuracy of initial moisture measurements. These calculations then provide a relatively accurate and reliable tool for drying control, as well as seed moisture and drying rate estimations any time during drying. Improvements in this area can result in improved accuracy of drying and improved efficiency in drying. It also is conducive to automation. Once the target exhaust temperature line is compared with actual plot of exhaust temperature, variation of drying factors to equalize both levels of energy can be made to have actual drying follow target drying. Drying factors (e.g. inlet air temperature and drying pressure) are controlled to equalize both levels of energy (i.e. the closer Current Energy is to Target Energy), more efficient drying. This is a way to monitor energy use and control it.

Automated Dryer Control System Exemplary Embodiment

The general method embodiment 100A described above can be the basis for a variety of different drying process regimens for different dryers and products to be dried. It also lends itself to semi-automation or full automation. An example method 100B (see FIG. 10A and FIG. 10B) relates to a system 10 that allows fully automated dryer control but selection of less automated modes. It is implemented in a dryer 12 (FIG. 9A) like that of U.S. Pat. No. 5,893,218.

Basic Components

Figure 9A:
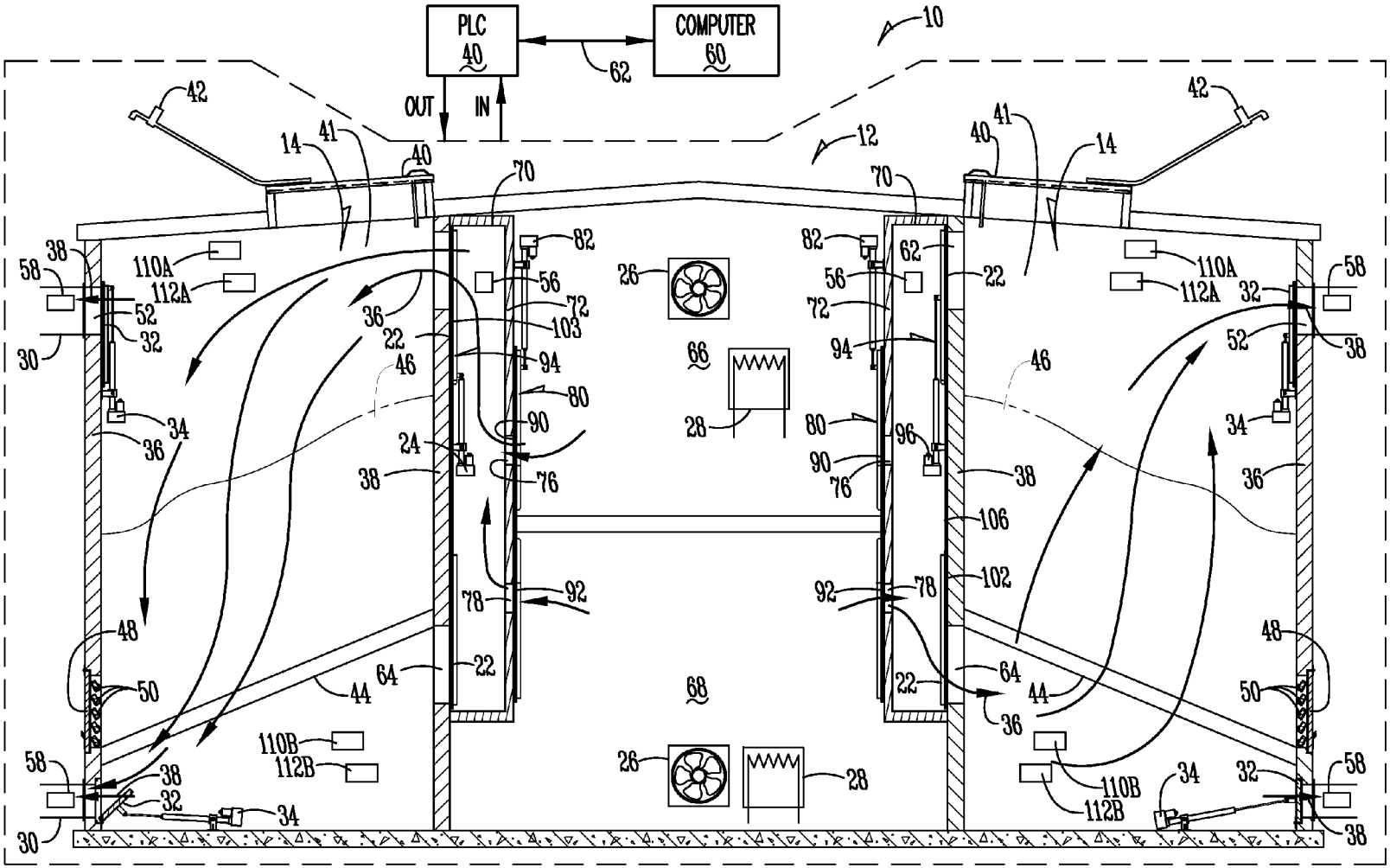
FIG. 9A is a diagrammatic depiction of a multi-bin heated air seed dryer with a drying control system according to an exemplary embodiment of the present invention.

FIGS. 9A and B diagrammatically illustrate a drying apparatus and system 10. A parent or commercial seed corn dryer 12 includes a plurality of individual drying bins or chambers 14 into each of which is placed a batch of ear corn supported on an air permeable grate. Each bin or chamber 14 is configured to hold a number of bushels of ear corn 18 to be dried. Further details of such a dryer can be seen at U.S. Pat. No. 5,893,218.

Each drying chamber or bin 14 includes at least one air inlet 20 and exhaust outlet 30. In system 10, there are two inlets 20 (upper and lower) and two outlets 30 (upper and lower). As illustrated in FIG. 9A, air flow can either be from upper inlet 20, through ear corn 18, and out of lower exhaust outlet 30 (see bin 14 on left side of FIG. 9A), or the opposite (see bin 14 on right side of FIG. 9A). A gate, door, shutter, or other member 22 is translatable relative to air inlet 20 over a range of positions between and including closed and open. A motor or actuator 24 controls the position of gate 20. A similar gate 32, controlled by motor or actuator 34, is operably positioned in exhaust outlet 30. A fan 26 and a heater 28 (two sets) are operably configured and positioned in each of upper hot air plenum 46 and lower cold air plenum 48. Air temperature in each mixing plenum 44 can be independently adjusted by selecting the appropriate mixture of hotter and colder air from plenums 46 and 48 by adjustment of gates or doors. Drying pressure and temperature of inlet air to each bin 14 can then be controlled by adjusting the inlet and exhaust doors 22 and 34, as well as the speed of fans 26 and the heat generated by heaters 28. As explained in more detail in U.S. Pat. No. 5,893,218, coordination of these components allows a variable air flow through or drying pressure in each drying chamber 14, and a variable inlet air temperature to each drying chamber 14 of dryer 12. Drying pressure and inlet air temperature can be independently controlled. Dryer 10 is configured in a single-pass drying mode, where heated inlet air is passed once through the ear corn and then exhausted.

Figure 9B:
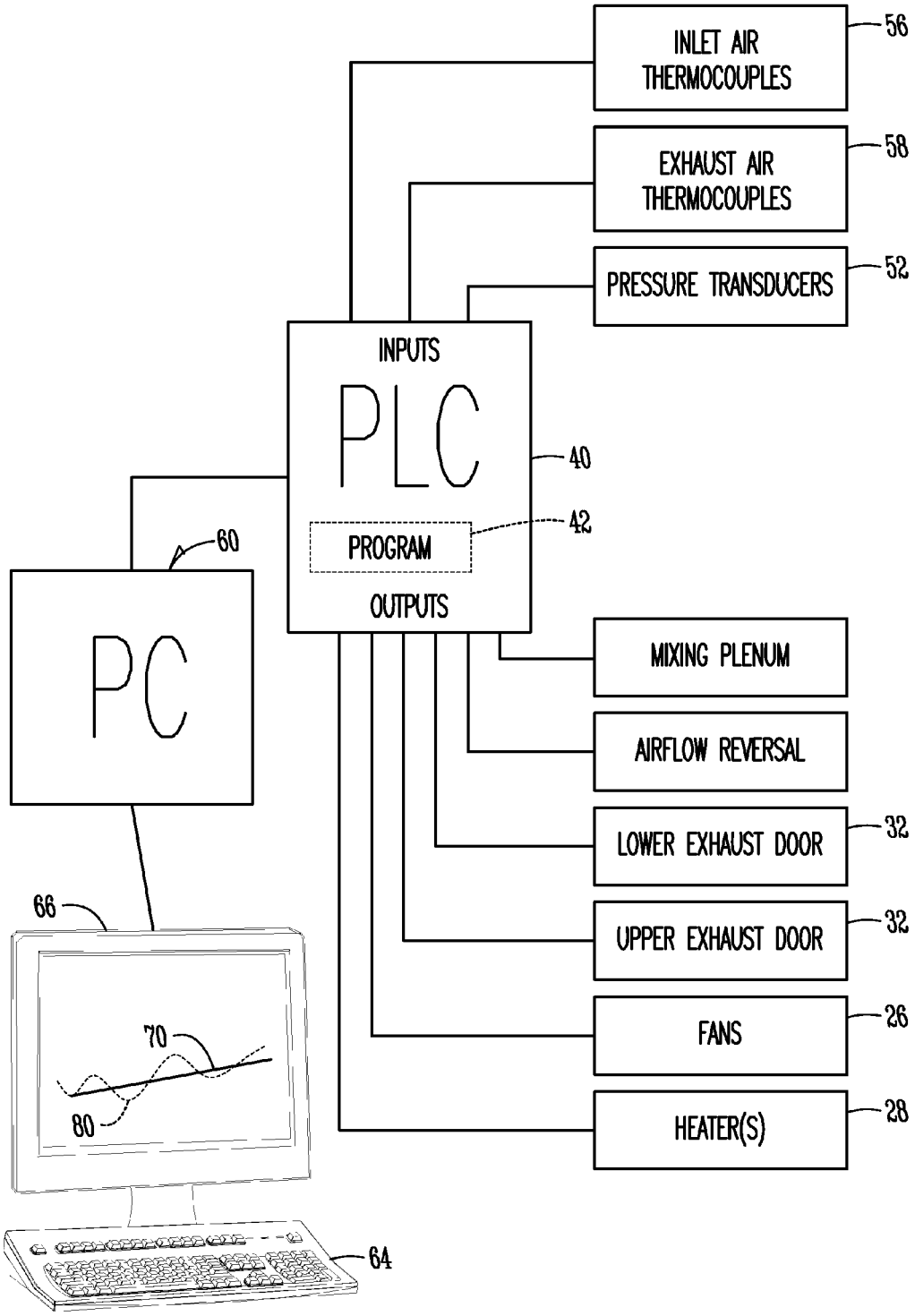
FIG. 9B is a block diagram of an Automatic Dryer Control System ("ADCS") for the drying system of FIG. 9A.

System 10 includes a programmable logic controller (PLC) 40. A variety of sensors are operably positioned and connected as inputs to PLC 40 (see also FIG. 9B). Temperature sensors (e.g. thermocouples) 56 and 58 monitor air temperature at air inlets 20 and exhaust outlets 30 respectively. Air pressure transducers 52 monitor drying pressure in each chamber 14, while humidity sensors 54 provide a humidity value for each chamber 14. There can be additional sensors of these types. For example, there can be additional thermocouples at other places (e.g. inside the drying chamber), or there can be multiple thermocouples to measure similar things (e.g. there is a thermocouple 58 at each of upper and lower exhaust air outlets 30 of each drying chamber or bin 14 so that exhaust temperature can be sensed regardless of whether exhaust is from the upper or lower exhaust outlet 30).

Outputs 46 from PLC 40 communicate instruction signals to operate or adjust operation of gate actuators 24 and 34, fan motor 26, and heater 28.

A computer 60 (e.g. desk-top or lap-top personal computer) is operably connected via communications link 62 to PLC 40. Computer 60 has a conventional keyboard 64 and display 66. Computer 60 could be used to install or change program 42 in PLC 40. It also can receive and store data in a database in memory. See also FIG. 9B. The components of system 10 can be obtained through conventional commercial sources.

U.S. Pat. No. 6,085,443 discloses the style of heated air seed dryer and also includes adjustable controls for air flow and inlet temperature for each drying chamber or bin. It could be modified to include a temperature sensor at the exhaust air outlet which would report exhaust temperature to the PLC. Also, dual pass type dryers like International Publication No. WO 97/29333 can also be modified to add sensors similar to those described above, including an exhaust air temperature sensor, as well as actuators to make adjustments to the drying process. However, as mentioned, it is difficult to control inlet temperature individually to each bin or chamber in dual pass dryers. Also, independent bin drying adjustment is more difficult because the dryer must be substantially balanced at all times and heated inlet air must pass through two bins before being exhausted. However, bin doors, bypass doors, or other methods can be used for variable adjustment of drying pressure.

Measurement Sub-Systems

Temperature readings from the thermocouples of system 10 are calibrated (e.g. with a thermometer and by ISO 9001-2000 standards) to ensure accuracy. Here a temperature sensor 58 is positioned to sense exhaust temperature at either the upper or lower exhaust outlet 30, depending upon which one is open during drying. System 10 would know which exhaust outlet 30 is open by reading the state of the actuator or its gate for both exhaust outlets. Gate position can be automatically sensed by PLC 40 in a variety of ways. One example is position sensors or switches which are calibrated to report gate position to PLC 40. Another example is position sensors or switches which are calibrated to measure state or position of a motor, hydraulic cylinder, or other actuator, where the state or position of the device is calibrated to closed or open positions for the gate it moves. Still further, actuators such as servo or stepper motors can report state or position to a PLC.

Drying pressure can be measured with a conventional pressure gauge 52 which is appropriately calibrated.

Humidity can be measured by conventional means 54 which is appropriately calibrated.

Fan speed can be measured by frequency of or other electrical characteristics.

Heater temperature setting can be sensed by electrical measurements or other methods.

Non-Automated or Semi-Automated Method

In a non-automated mode of operation, program 42 could simply display control line 70 on computer screen 66 with exhaust temperature 80 superimposed. As will be discussed later, a target range could be displayed by adding upper range limit control line 71 and lower range limit control line 69. This would provide a visual range of target exhaust temperatures during operation (see FIG. 1). The operator could select this display for each drying bin, and manually adjust inlet air temperature and/or drying pressure, as needed, for each bin to try to maintain exhaust temperature line 80 as close to control line 70 for its bin as possible. This adjustment could be by direct control of such things as the heater, the fans, and the air gates.

Alternatively, adjustment of the heater(s), fan(s), and gate(s) could be semi-automated. For example, instructions to adjust the heater, fans, and/or appropriate air gates could be manually entered by the operator to the PLC or computer, which could then send signals instructing the heater, fans, and/or air gates accordingly.

Automated Method (ADCS)

Figure 10A:
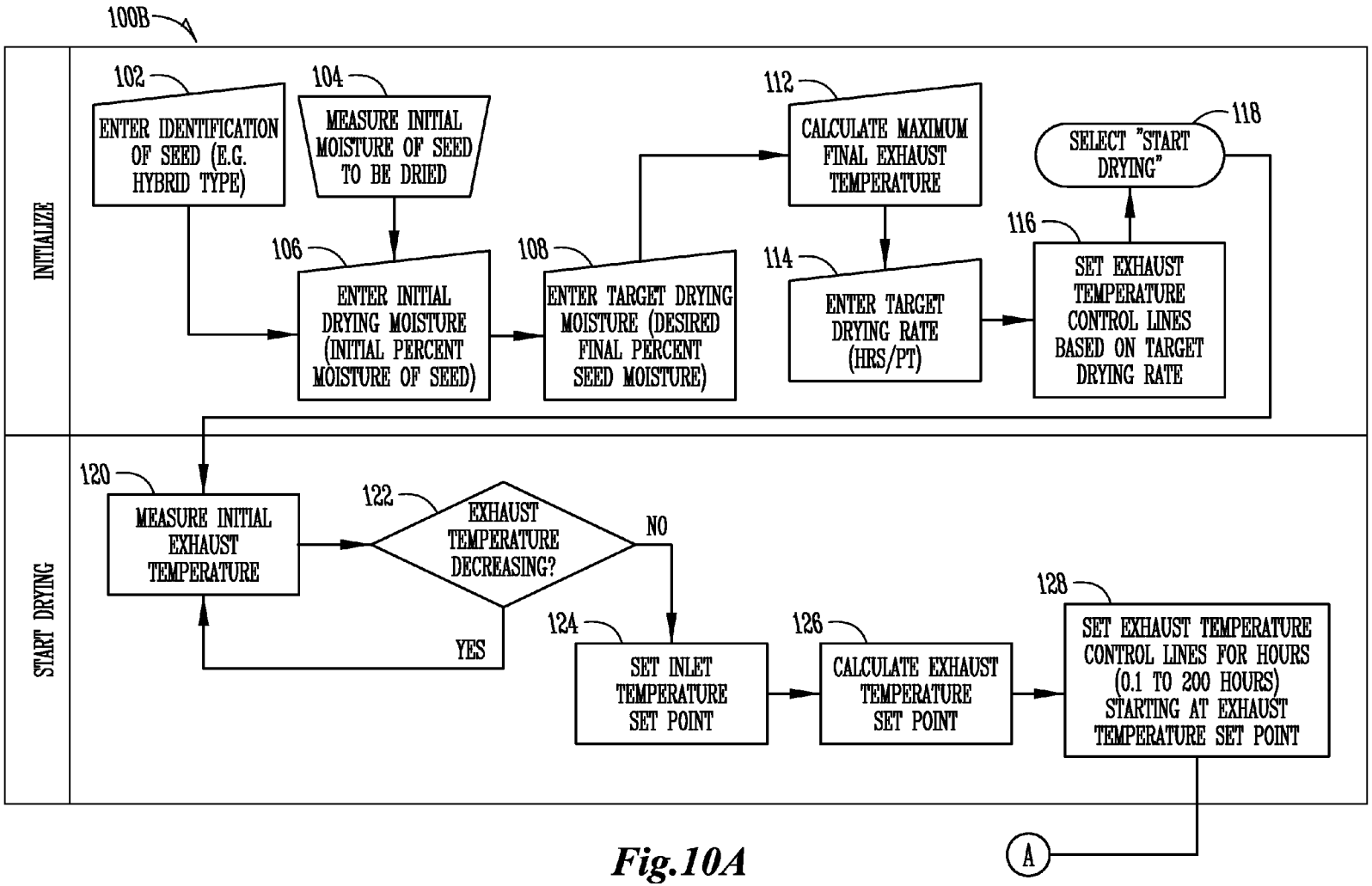
FIG. 10A and FIG. 10B provide a flow chart of a method of operation of the seed dryer system of FIGS. 9A and B.
Figure 10B:
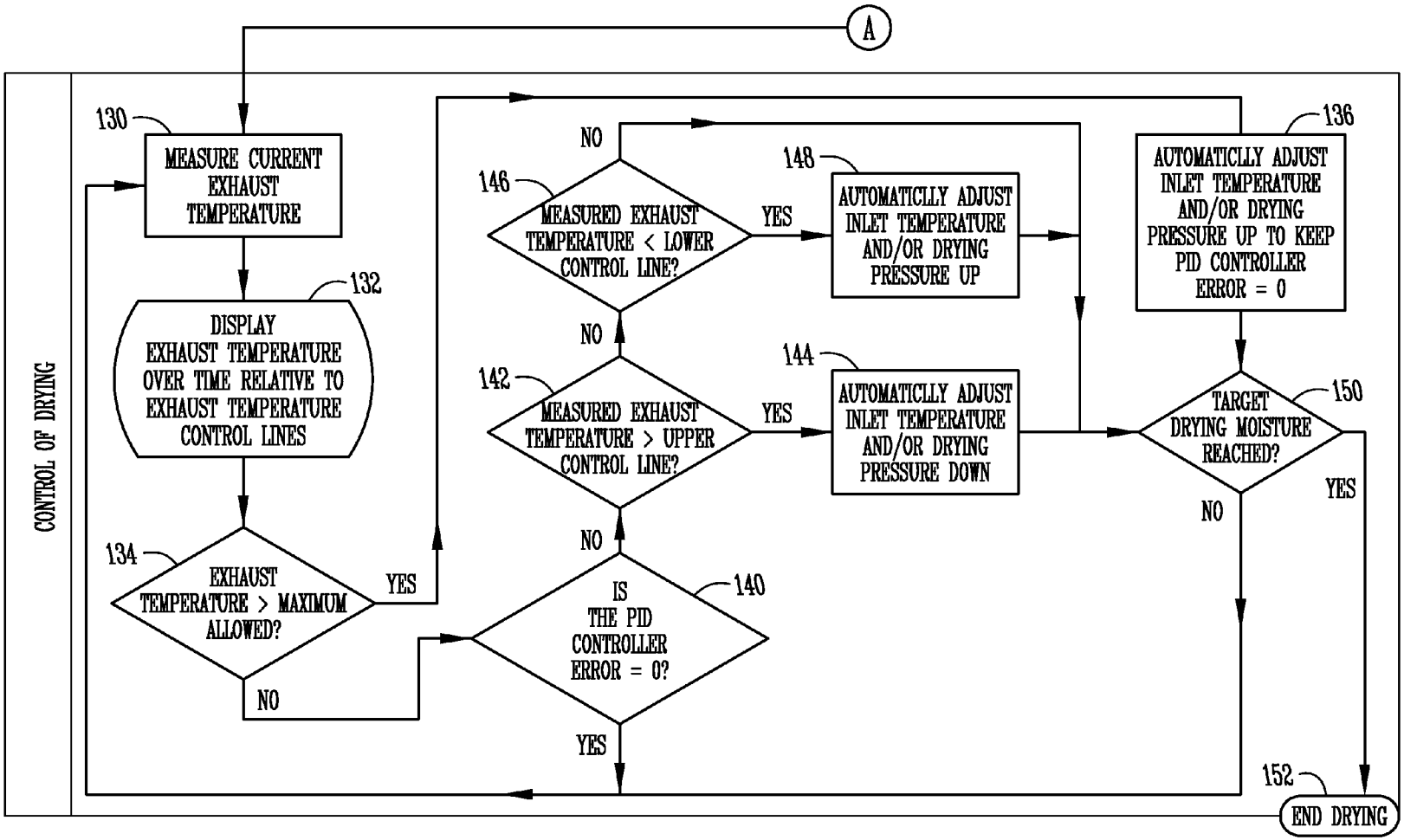

The drying method can also be implemented in a fully automated drying process, here sometimes referred to as the Automatic Drying Control System (ADCS) program. FIG. 10A and FIG. 10B provide a flow chart of such a drying method 100B. The ADCS program could essentially cause the PLC to automatically control the drying of each bin. By knowing the target exhaust temperature rate 70 for each bin, the ADCS program could monitor exhaust temperature performance from exhaust temperature sensors 58 (e.g. thermistors), compare it with the target line 70 or target range between lines 69 and 71 (or some other correlated function related to target or desired drying rate), and automatically adjust inlet air and/or drying pressure in a manner likely to cause exhaust temperature to stay within or at least close to the control range.

In this example, the control lines can each be expressed essentially as a linear equation. Measured exhaust temperature can be plotted relative to the control lines at corresponding times. The ADCS program can be programmed to respond to an exhaust temperature trending away from line 70 (The control lines 69 and 71 are not used in the ADCS. The ADCS utilizes a PID control system, as explained below (25). PID=proportional, integral and derivative controller).

One method would be to first try incremental increases or decreases, as appropriate, in inlet air temperature until the trend away from line 70 reverses to towards line 70. Exhaust temperature would be monitored and increases or decreases discontinued if exhaust temperature returns within range. Another would be to use an algorithm that first tries small increases or decreases, and then increasingly larger ones until the trend reverses. A wide variety of other feed-back type or comparison and error correction functions are known and could be used.

The ADCS program 42 is created and installed in PLC 40 by known methods. ADCS program 42 allows operator input of certain set-up or initialization values or information prior to starting the drying process. In this example, entry is manually via keyboard 64 of computer 60, but it could be by other means.

Figure 11:
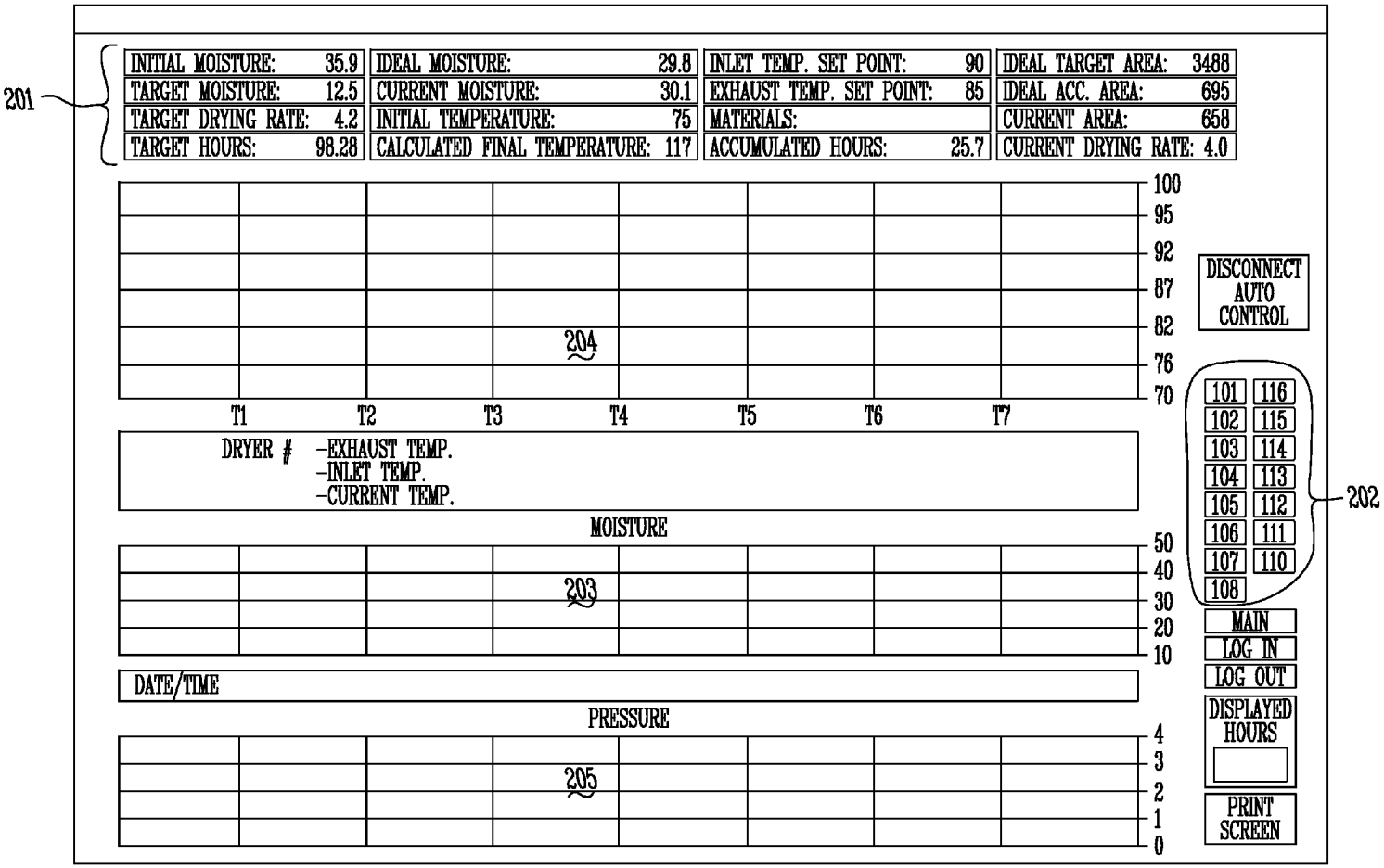
FIG. 11 is a representation of a set-up screen on a computer display for initializing the ADCS under the method of FIG. 10A and FIG. 10B.

FIG. 11 illustrates an operator display screen 66 for computer 60. As indicated, the screen can include fields for the operator to populate with the type of initialization information described above. As shown, it can be pre-configured for a particular dryer to have the appropriate number of fields for the number of drying chambers of the dryer. Screen 66 supplies the following types of information:

Displays.

Bin selection. Section 202 of screen 66 displays individual icons representing each bin 14 of dryer 12 which can be independently monitored and controlled. Operator selection of one icon while display a screen 66 for that selected bin. The operator can sequence through all operating bins as desired.

Visual, real-time exhaust temperature plot. Section 204 of screen 66 presents essentially a real-time plot 80 of exhaust temperature (y-axis) versus drying time (y-axis); i.e. the exhaust temperature rate. This exhaust temperature plot 80 can be superimposed over a pre-determined or assigned set of exhaust temperature control lines 69, 70, and 71 like those of FIG. 1. The operator is given a real-time visual comparison of how well actual measured exhaust temperature follows over time a target exhaust temperature range. A display of moisture level can be plotted in real time in area 203 of screen 66. Drying pressure can be plotted in area 205.

Information.

Section 201 of screen 66 presents the following types of information to the operator:

Inputs a) Material—name of material or product (e.g. type of seed and/or hybrid identifier, etc.) to be dried.

b) Initial Moisture—measured actual percentage moisture in seed in selected bin before drying process commences.

c) Target Moisture—goal for final percentage moisture of the seed at end of drying.

d) Initial Temperature—exhaust temperature measured for bin at the beginning of the current drying period.

e) Target Drying Rate—desired drying rate for the drying period.

Calculations made by the controller:

f) Target Hours—total drying hours—calculated from Initial Moisture, Target Moisture and Target Drying Rate.

g) Target Moisture—calculated using Initial Moisture, Target Drying Rate.

h) Current Moisture—calculated estimated moisture at any selected time during drying using Initial Moisture, Target Drying Rate, and Current Area (also can be plotted in display area 203).

i) Calculated Final Temperature—estimated exhaust temperature at the estimated end of the drying period. This also allows an estimate of "Calculated Final Inlet Temperature" at end of drying period.

j) Inlet Temperature Set Point—inlet air temperature value set to obtain the desired exhaust temperature at anytime during drying. It can change automatically depending on exhaust temperature requirements. It is selected when exhaust temperature rate indicates bin moisture is stabilized.

k) Exhaust Temperature Set Point—required target exhaust temperature at anytime during drying period. The value determines a Target Area to dry at the target drying rate.

l) Accumulated hours—hours accumulated from beginning of automatic drying.

m) Target Area—area under the Target Exhaust Temperature line. Calculated considering the Initial Temperature, Calculated Final Temperature, Target Hours and Target Drying Rate. It must be in compliance at the end of drying.

n) Target Accumulated Area—accumulated area under the Target Exhaust Temperature line from beginning of drying up to current drying time (see FIG. 8A). It must match Target Area at end of drying period.

o) Current Area—area under Current Exhaust Temperature from beginning of drying up to current drying time (see FIG. 8B).

Of course other values or information can be displayed on screen 66. The operator can manually, or otherwise, enter requested or required information via keyboard 64 for each bin 14 of dryer 12. Alternative values may be set automatically by the control system.

Buttons:

p) Start drying. Operator selects to begin ADCS drying.

q) Disconnect or Quit Program. Operator manually selects to discontinue ADCS drying.

By simple selection from screen 66, the operator can enable the ADCS program. Likewise, the ADCS could be disabled by the operator. It can be disabled for all bins or any one or more selected bins. When disabled for a bin, the program confirms the disconnection and the inlet temperature and pressure set point will remain at the set values. The operator can then manually control all dryer functions. This would allow the operator to manually control dryer operation, but still utilize the display 66 to visually show the real-time plot of exhaust temperature relative to the control range. Similarly, just certain controllable devices can be selectively enabled or disabled. For example, automatic control of a heater 28 could be disabled.

Program 42 also allows the reverse. At anytime during a drying period which begins without ADCS control, the operator could instigate ADCS. PLC 40 would take over the drying process according to its programmed regime.

Although method 100B can be implemented with just one drying bin 14, here dryer 12 has a plurality of chambers or bins 14 each holding, on a support grate in the bin or in a moveable hopper car, one batch of ear corn. Each bin 14 has independently controllable air flow and inlet air temperature, and inlet and outlet temperature sensors, as well as a drying pressure sensor.

More details about automatic control under ADCS program 42 are as follows.

Initialization and Set-up

Initialization Variables

The operator enters the following primary variables.

(a) Identification of seed (FIG. 2, step 102).

A unique identifier can be used to identify the Material (e.g. each set of seed to be dried). Information related to the set of seed can be recorded and stored. The unique identifier could be associated with information about the set of seed. Examples of such information would be hybrid type, growing location, etc. The identification can be recorded and stored (e.g. in a database) so that information about each set of seed can be associated with the information as well as information about its drying. The identification and type of associated information can be selected according to desire or need. For example, only hybrid type correlated to bin might be needed.

(b) Initial Moisture.

By known methods, Initial Moisture (e.g. seed moisture as a percentage of the seed's dry weight) should be measured (step 104) and entered (step 106). A variety of ways exist to measure seed moisture exist and are well-known in the art.

Grain moisture content may be determined by direct or indirect methods. Direct methods are commonly used for laboratory work where exact determination is critical. One example is Lab Oven Dry Matter testing. The grain sample is heated to drive off moisture and weighed before and after heating, according to a standardized procedure, to find water loss.

Moisture meters commonly used with farm drying installations measure moisture indirectly. They measure the electrical conductance or capacitance of the grain, since moisture in grain affects these electrical properties of the kernels. A reading on the moisture meter is converted to a moisture reading by use of a calibration chart or table. They are less accurate than lab testing. An example is a 2100 Agri model grain tester from Dickey-John Corp., Auburn, Ill. 62615 USA (approximately 30 second measurement period, 5%-45% measurement range). They can be combined for cross-checking, or one used to calibrate the other.

(c) Target drying moisture.

The desired final seed moisture is entered (step 108). This can be from recommended standards or otherwise. One standard for parent seed corn is between 11% and 13%, and typically 12.5%. See International Publication No. WO 97/29333, incorporated by reference herein.

(d) Maximum initial drying inlet temperature.

As mentioned, drying air temperature cannot be too extreme or it risks affecting the seed and/or the ability to dry effectively.

ADCS is programmed with the maximum inlet temperature parameters established in the Quality Plan, which are related to the initial moisture of the seed.

In this example, initial dryer inlet air temperature can be selected according to the following two choices: 1) 30° C. (86° F.) for Initial Moisture of <34%; and, 2) 25° C. (77° F.) for Initial Moisture of >34%, as described earlier.

(e) Maximum final exhaust drying temperature.

A maximum final dryer exhaust air temperature is calculated or estimated (step 112) based upon the known and the entered Target Drying Rate. Again, drying temperature cannot be too extreme any time during drying.

(f) Target Drying Rate.

A desired drying rate (hours per percent seed moisture loss or hrs/pt) is entered (step 114). This can be according to standards or otherwise. As mentioned, one standard for parent seed for corn is 4.0 hrs/pt. This can also be used for commercial seed.

Control Lines

In the ADCS the control lines are replaced with an algorithm control (PID equation) that compares the error between the target exhaust temperature and the current temperature.

From the selected Target Drying Rate, a target control line is created. The target exhaust temperature line for seed corn can be:

| Control line | Slope | Based on drying rate of: |
|---|---|---|
| Target line 70 | 0.25 | 4.0 hrs/pt |

Beginning Drying

After initialization, the operator can select from screen 66 to start the drying process (step 118) for any or all bins 14. During an early part of the drying period events occur such as described in the sections below.

Set Point For Control Lines

The program 42 commences the drying process by instructing the appropriate devices of system 10 to introduce heated air flow into chamber 22 (e.g. via actuation of fan(s) 26 and heater(s) 28, and/or opening of gate(s) 24 and 34). The program brings inlet air temperature progressively higher (not to exceed allowed maximum), and drying pressure in chamber 22 up to a pre-designed level.

As this drying process start up proceeds, the program evaluates measures of exhaust temperature (step 120) and continues as long as exhaust temperature decreases (step 122) during this initial period of time. When exhaust temperature stabilizes according to one or more of the tests described above, the setting or starting point is selected (steps 124, 126, and 128). Setting point 82 can be automatically determined by the program through evaluation of behavior of initial exhaust temperature to identify the time of bin moisture stabilization. From this point, the control line 70 can be plotted relative to future drying hours. Since the slope of the lines is pre-determined, the control lines are set for the duration of drying without further calculation.

Automatic Drying

After the set point is determined, and the control line is set relative to future drying hours, the program continues to monitor exhaust temperature measurements (FIG. 10B, step 130). The frequency of exhaust temperature measurements pre-determined. In this example, exhaust temperature is measured and reported to the PLC 40 periodically.

In this example, the control lines can be visually displayed (step 132) (e.g. on computer screen 66 in the form of FIG. 1).

In the case of ADCS with PLC 40, the program 42 would compare the measured exhaust temperature (step 130) to a maximum allowed exhaust temperature (step 134). If maximum is reached, method 100B would adjust exhaust temperature solely by adjusting drying pressure, so as not to exceed allowable inlet temperature maximum (step 144).

So long as maximum inlet air temperature is not exceeded, the program would check if exhaust temperature (or its rate) is within the margin of error related to the exhaust temperature line. (step 140).

If within the relevant margin of error, the program would continue to monitor exhaust temperature (steps 140, 130, 132, 134).

In system 10, PLC 40 will be informed of at least the exhaust air temperature from sensor 58. PLC 40 can instruct variable drying pressure and inlet air temperature by control over at least one of doors 22 and 32 and/or fan 26, as well as heater 28.

If the former, the program would automatically adjust a drying factor of the dryer to urge a decrease in exhaust temperature back within the margin of error (step 144). In method 100B, the controllable drying factors are inlet air temperature (e.g. by increasing the temperature of the heating element of heater 28) and/or drying pressure (e.g. by incrementally moving an exhaust air gate 32 towards closed position and/or incrementally moving inlet air gate 22 toward completely open to increase air pressure inside chamber 22 and/or increasing the speed of fan 26). According to well-known laws of physics, various combinations of the foregoing can be used to increase air pressure in chamber 22. In this example, increase of inlet air temperature is the primary variable which is controlled. But, as mentioned, if inlet air temperature exceeds an allowable maximum, drying pressure would then be used, but drying pressure is secondary until that event.

As can be appreciated, the program 42 can be set to adjust inlet air temperature and/or drying pressure according to a pre-determined behavior. As mentioned, it could be an incremental adjustment up or down. The magnitude of the increment(s) can be identical. Program 42 would check to see if target drying moisture has been reached (step 150), and if so, end the drying process for that bin. But if not, program 42 would loop back through taking another exhaust temperature measurement (step 130) and if still outside the margin of error, instruct another incremental decrease in inlet air temperature and/or increase in drying pressure, until exhaust temperature is back within range (for the relevant margin of error associated with that particular Drying Hours).

The magnitude of the adjustments depends on the PID equation, related to the proportional and integrated error. The velocity of the control action can be adjusted using the internal parameters of the PID (proportional band, integrated time and derived time).

As can be appreciated, the ADCS method 100B can automate drying for a single chamber 22, or multiple chambers 22, as needed. After initialization for each bin, and after set-up, ADCS would automatically operate dryer 12 according to the control lines for each bin 14. This allows automated dryer control for many bins with one PLC 40.

The operator could monitor the process of drying in each bin 14 by selecting the bin number on screen 66 and examining the real-time plot of exhaust temperature superimposed on control lines 69, 70, and/or 71 for that bin. If for some reason program 42 is not keeping exhaust temperature within an acceptable range over time, the operator could check on the dryer operation or on the particular chamber or could, optionally, disable automatic control of that bin and adjust exhaust temperature by manually adjusting inlet air temperature and/or drying pressure.

Optionally, the operator could disable automatic control from the beginning of the drying process. The operator could sequentially call up control lines 69, 70, and 71 for each bin on display 66 and manually input instructions via computer 60 to adjust one or more of drying pressure or inlet air temperature to maintain exhaust temperature curve 80 as close as possible to target line 70. Alternatively, the operator could directly adjust any of doors 22 and 32, fan 26, or heater 28 towards that end. By experience and empirical methods, the operator could become skilled at making adjustments to keep curve 80 in quite close correspondence with target line 70.

ADCS program 42 could also automatically discontinue operation under certain conditions. Examples are:

1. When Current Area=Target Area and Target Hours are completed.
2. When Current Area=Target Area before Target Hours are completed.
3. When the drying program is finalized.

If ADCS program 42 is restarted during drying, new Initial Moisture, Target Moisture, and Target Drying Rate values must be entered.

Summary

Method 100B automatically monitors, but also automatically adjusts exhaust temperature to control drying. Thus, by the metric of exhaust temperature, the system autonomously controls at least one drying factor to keep exhaust temperature within or close to a desired tolerance range. This promotes accuracy of drying rate to deter seed damage, while at the same time promotes more efficient drying for higher throughput.

EXAMPLES

Overview

Several trials using exhaust temperature control to control drying were conducted.

Example 1

Single Pass Dryer

In a first trial, a dryer like that of U.S. Pat. No. 5,893,218 was used under the following conditions:

| | |
|---|---|
| Products | 2 different types |
| Target Drying Rate | 4 pts/hr |
| Control lines | Three at 3.5, 4.0, and 4.5 hrs/pt (with slope of the 4.0 line being 0.25) |
| Bin Filling Depth | 6-9 feet |
| Drying factors utilized to control Exhaust Temperature | Inlet Air Temperature and Drying Pressure |
| Number of Bins Analyzed | 23 |

Some results of the trials were:

| | |
|---|---|
| Range of Initial Moistures | 27-37% |
| Range of Final Moistures | 11-13% |
| Range of total Drying Hours | 71-105 |
| Range of Drying Rates | 3.7-4.4 |

Figure 12A:
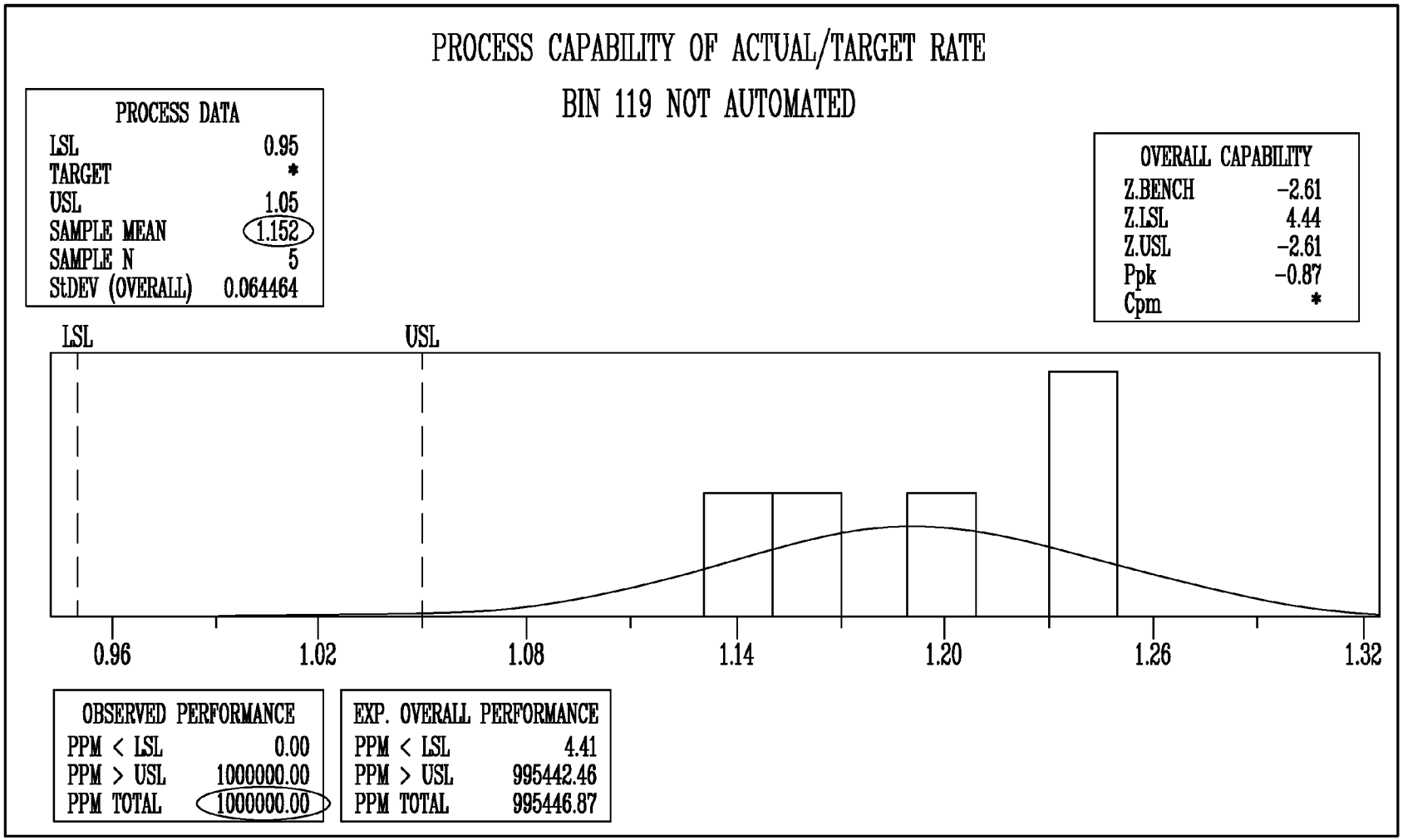
FIGS. 12A-C are graphical representations illustrating drying rate performance of a dryer without the ADCS method (FIG. 12A) and with the ADCS method (FIG. 12B).
Figure 12B:
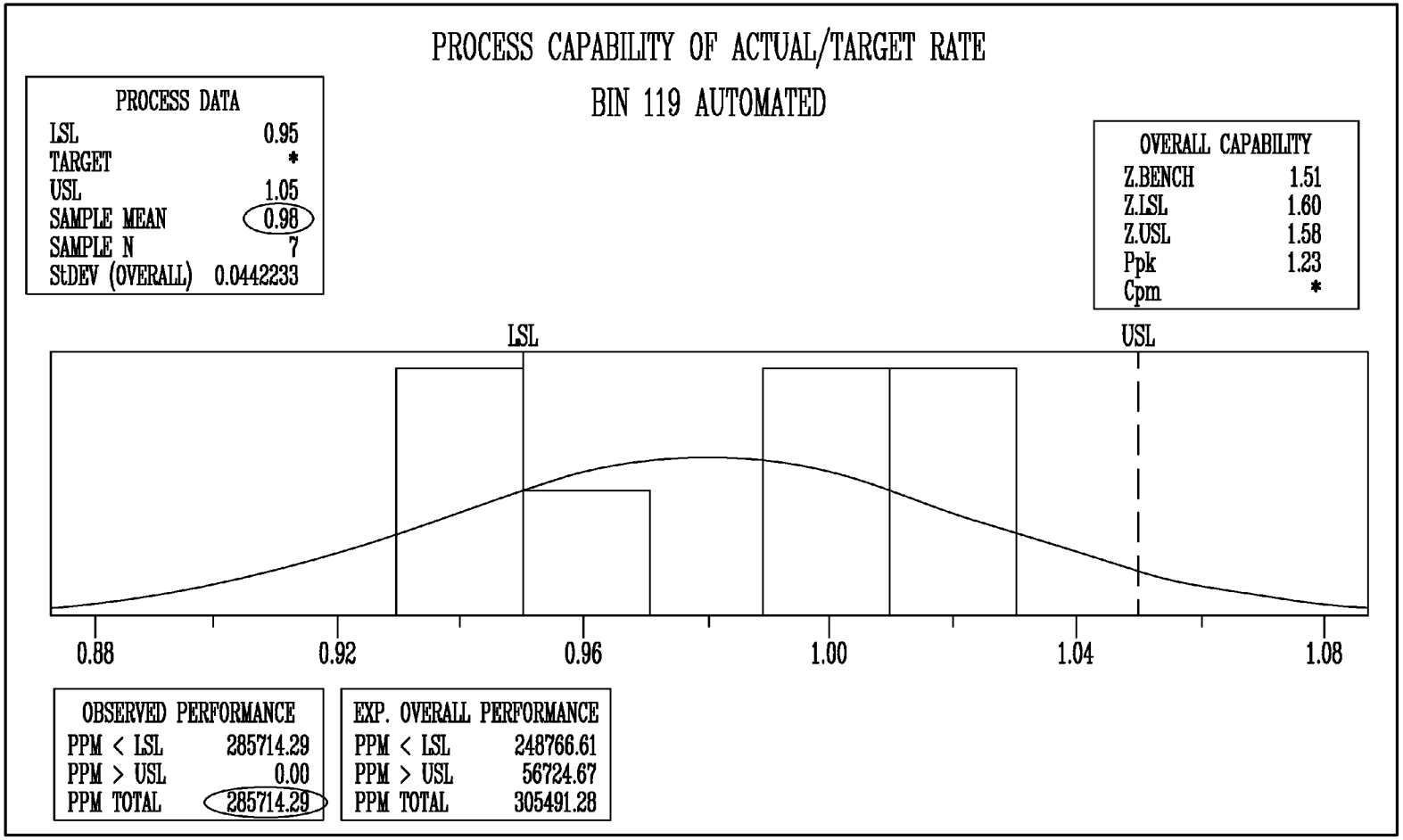
Figure 12C:
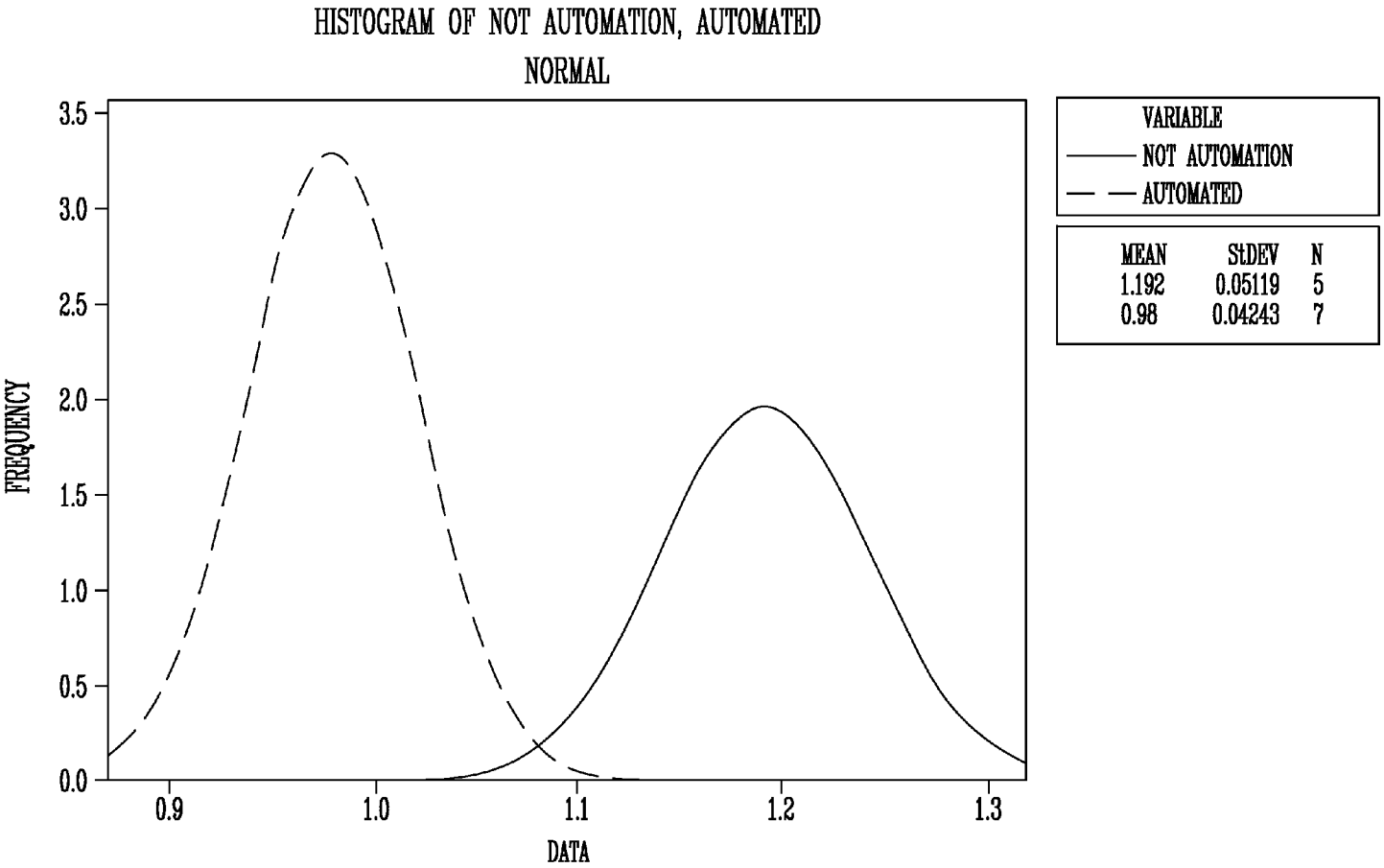

Results of the trials of this test are indicated in FIGS. 12A-C. FIG. 12A corresponds actual to target drying rate for trials without automatic control. The mean of the comparison was 1.152. FIG. 12B plots a comparison of actual to target drying rate for ADCS automatic control. The mean was 0.98.

Figure 13A:
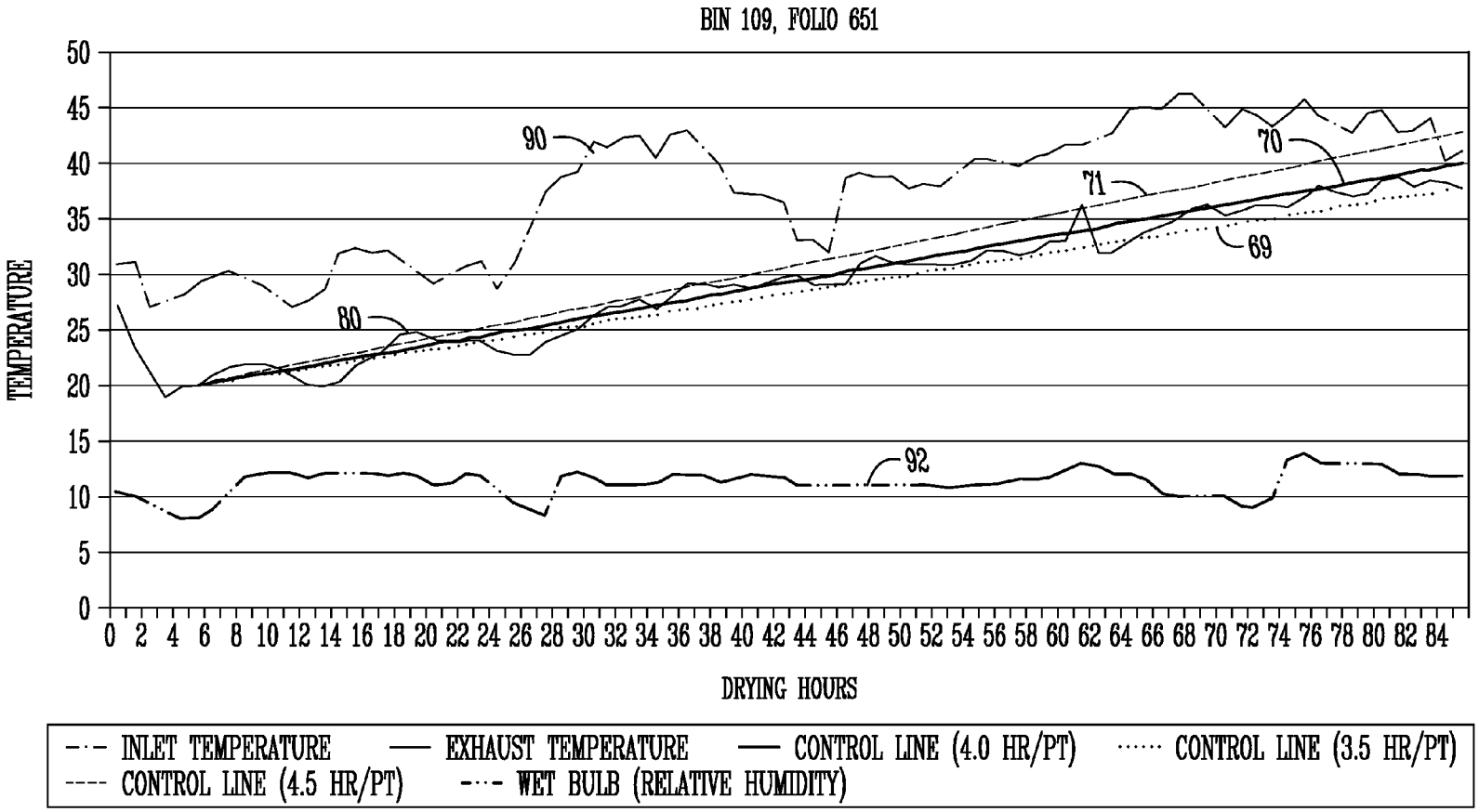
FIGS. 13A and B are graphical representations of an example of a drying process having a target drying rate of 4.0 hrs/pt, +/−0.2 hrs/pt, and measured drying parameters during drying, according to the method of FIG. 10A and FIG. 10B.
Figure 13B:
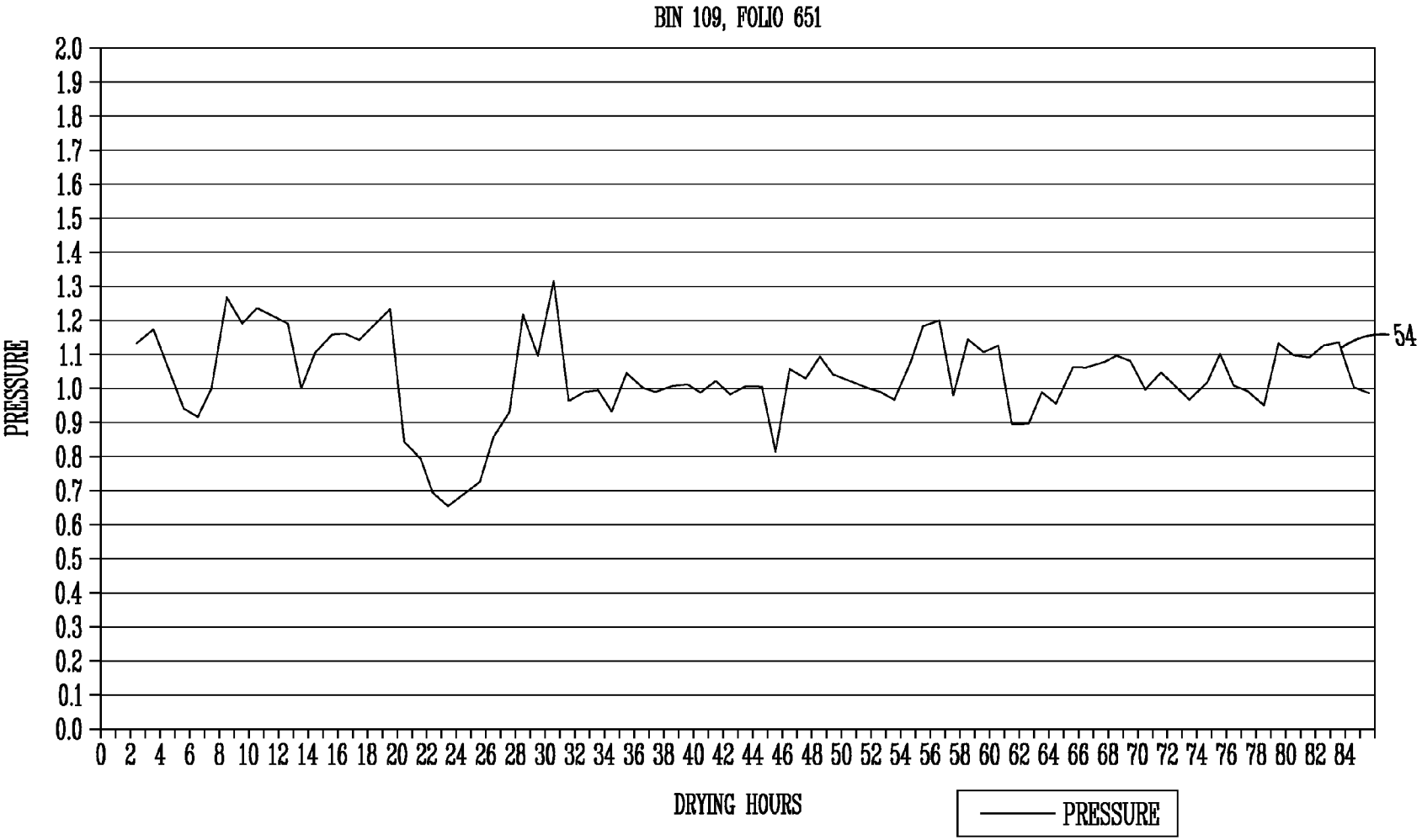

FIGS. 13A and B are a set of graphical plots of measurements from one bin of these trials (bin number 109). FIG. 13A shows control lines 69, 70, and 71 from a setting point. It also superimposes exhaust temperature 80, inlet temperature 90, and wet bulb temperature 92 (from which relative humidity can be derived). FIG. 13B plots drying pressure relative to the same scaled hours as the temperatures plotted in FIG. 13A. As can be seen, exhaust temperature curve 80 is constrained within upper and lower control lines 71 and 69. It also indicates how inlet temperature is the primary drying factor which is adjusted.

Figure 14A:
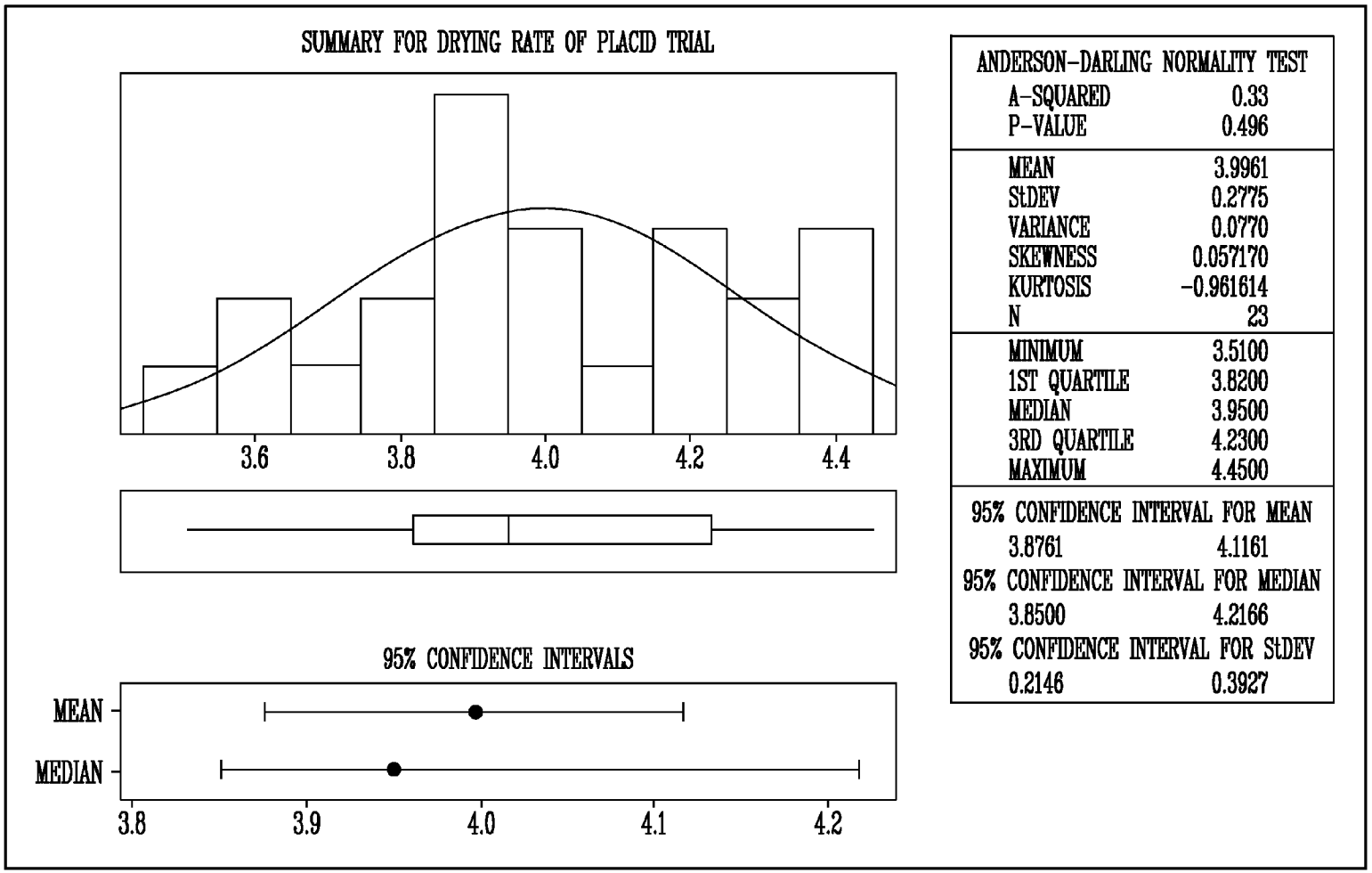
FIGS. 14A and B are graphical representations of relationships between drying rate of a first type of dryer and a target drying rate of 4.0 hrs/pt, +/−0.2 hrs/pt.
Figure 14B:
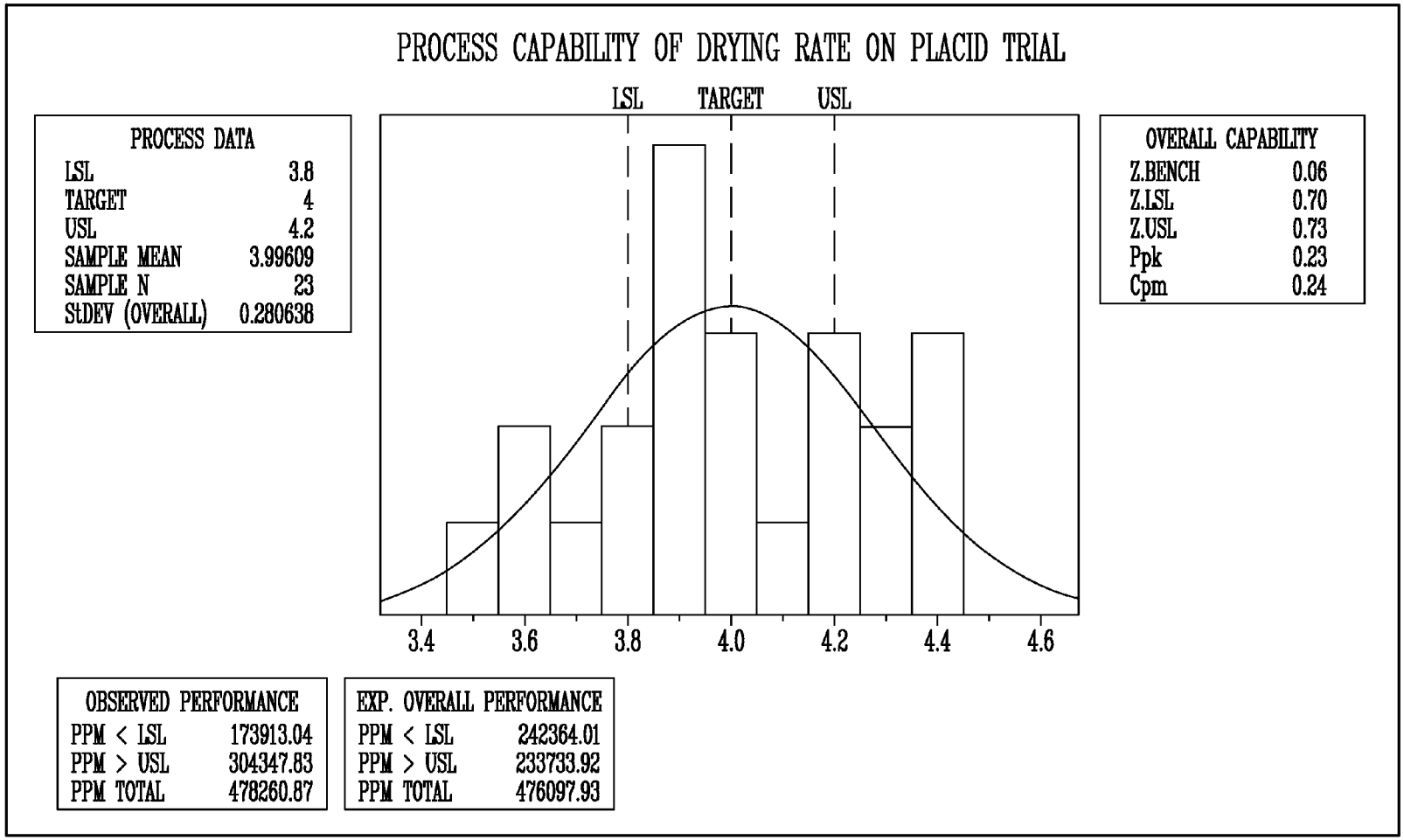

FIGS. 14A and B illustrate actual target drying rate in the trials compared to predicted performance. For a target 4.0 hrs/pt, mean actual drying rate was better than 3.99 hrs/pt with a standard deviation of 0.277.

Example 2

Double Pass Dryer

I. A trial was conducted with a dual pass dryer under following the same conditions as Example 1, with the following exceptions:

| | |
|---|---|
| Drying factors utilized to control Exhaust Temperature | Primarily Drying Pressure |
| Number of Bins Analyzed | 9 |

Results of these trials were:

| | |
|---|---|
| Range of Initial Moistures | 34-40% |
| Range of Final Moistures | 11-12.5% |
| Range of total Drying Hours | 95-112 |
| Range of Drying Rates | 3.5-4.0 |

Figure 15A:
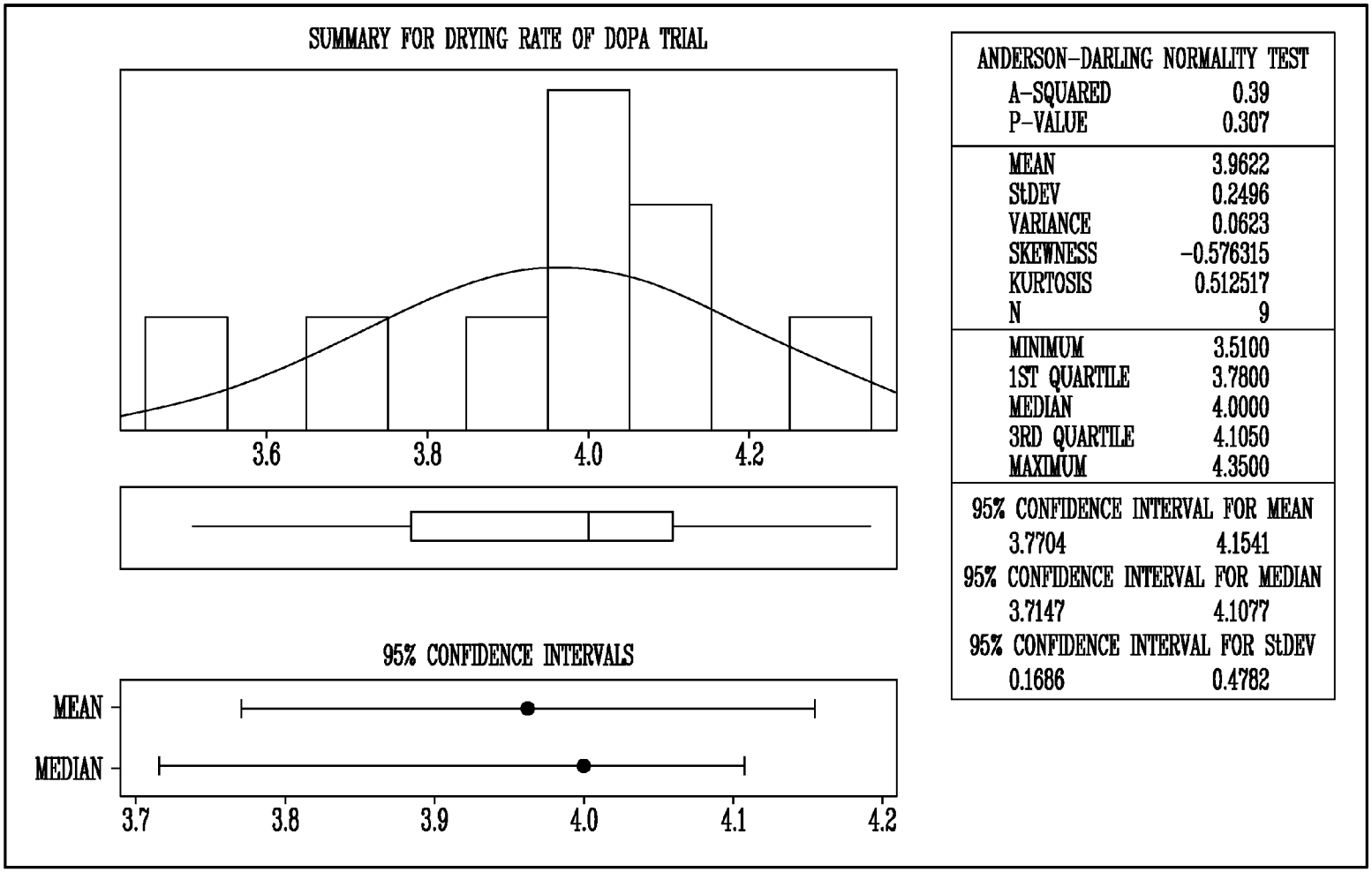
FIGS. 15A and B are graphical representations of relationships between drying rate of a second type of dryer and a target drying rate of 4/0 hrs/pt, +/−0.2 hrs/pt.
Figure 15B:
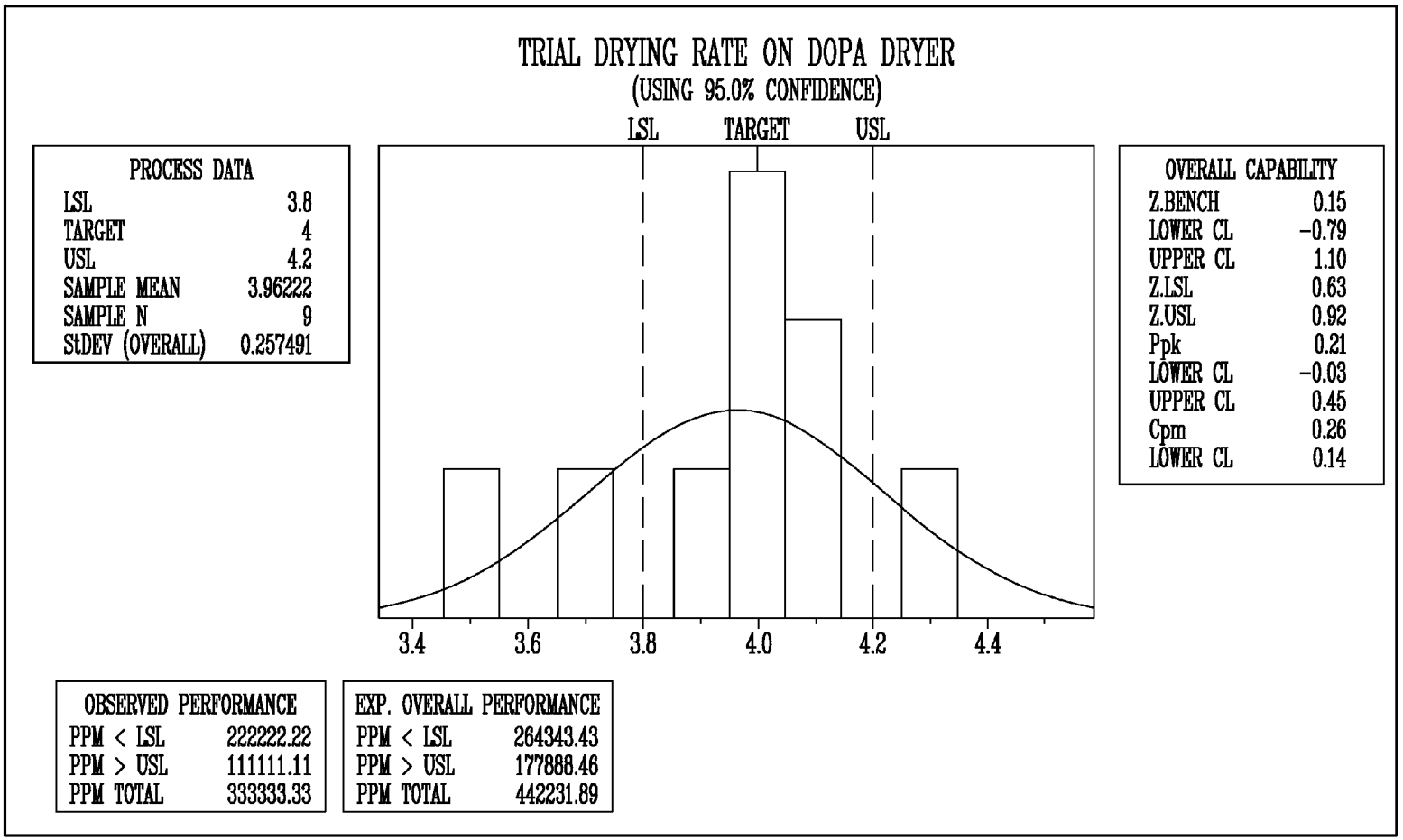

As can be seen in FIGS. 15A and B, mean drying rate was slightly over 3.96 hrs/pt, with a standard deviation of 0.2496.

Figure 16:
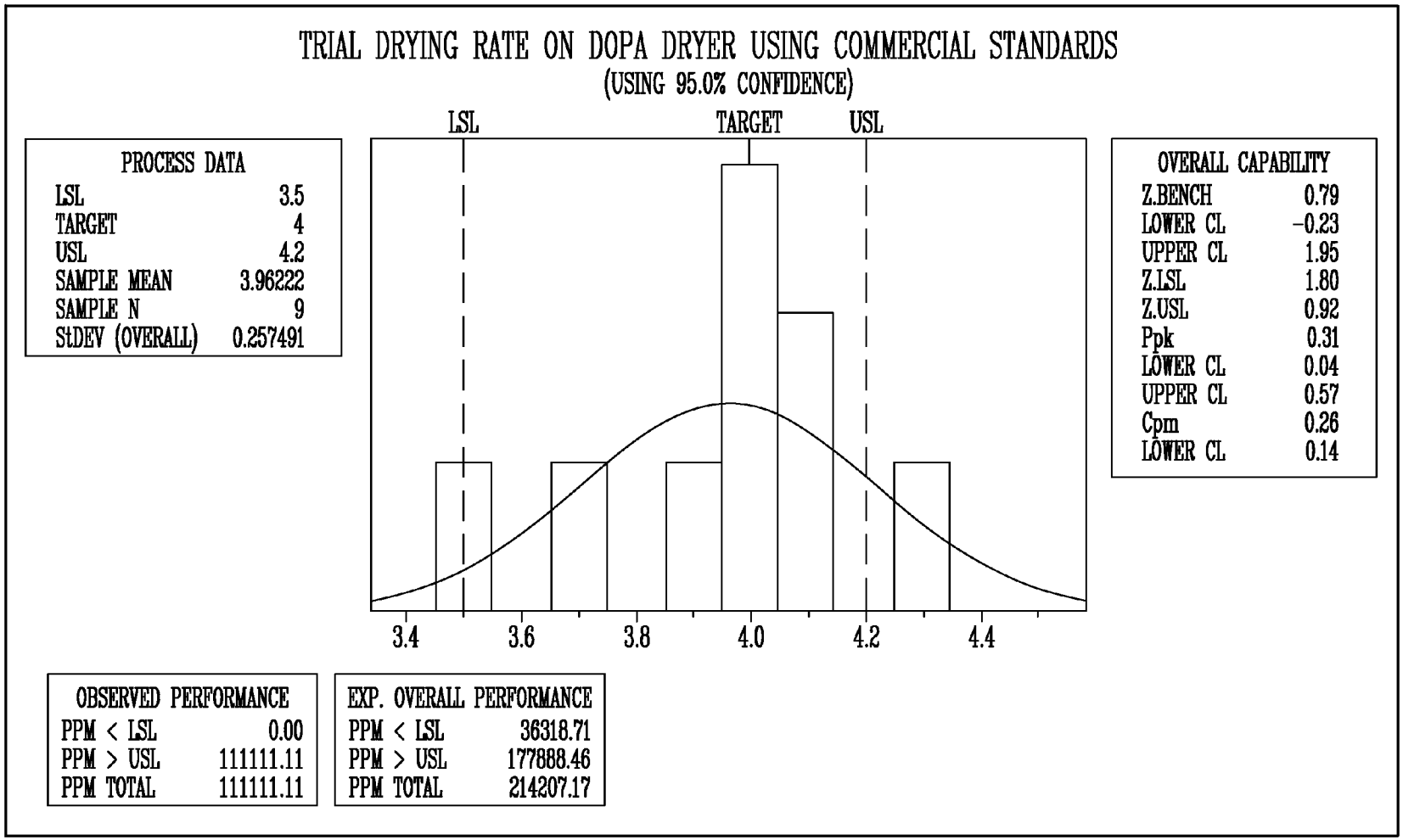
FIG. 16 is a graphical representation of relationships between drying rate of the second type dryer and a target drying rate of 4.0 hrs/pt, but +0.2 hrs/pt and −0.5 hrs/pt.

II. Another dual pass dryer trial was conducted under similar same conditions as section I, except that the lower control line was lowered slightly to correspond to commercial seed corn drying quality standards. It can be seen that mean drying rate also was around 3.96 hrs/pt, with a standard deviation of about 0.257 (see FIG. 16).

Options and Alternatives

The foregoing exemplary embodiments and examples are but a few forms that various aspects of the invention can take. Variations obvious to those skilled in the art are included within the invention, which is defined solely by its claims. Some examples of options or alternatives are as follows.

As mentioned, it has been found that the method can be applied to several types of dryers. It may be applicable generally independent of dryer type. While the examples describe application to batch air dryers, it is believed applicable to continuous feed air dryers, and other types of dryers where a reasonable correlation between exhaust temperature and drying rate can be established.

The examples relate to corn seed. The method can be applied to corn seed independent of its environmental growing conditions, its genotype, or its traits and characteristics. It is also believed the method can be applied to other types of seed. It is also believed that the method could be applied to other granular or particulate matter.

The main drying factors identified are drying method, and the main drying factors for the drying method are identified as inlet air temperature and drying pressure, with drying pressure being secondary.

The exemplary embodiments utilize a control line that is a straight line. However, it could take on different shapes or even mathematical functions. One example is as follows. First hours of drying after the setting point could be at a lower temperature than later hours. This may further help avoid over-drying and damage to seed or other product.

What is claimed is:

1. A method of drying of a product in a drying bin from an initial moisture content to a final moisture content with heated air and drying pressure comprising:

a. deriving a correlation between a target exhaust temperature rate and a target drying rate for the product;

b. during a first portion of a drying period, assigning a set point for the target exhaust temperature rate by measuring actual exhaust temperature and determining when exhaust temperature is stabilized;

c. for a second portion of the drying period, measuring actual exhaust temperature, comparing measured exhaust temperature to the target exhaust temperature rate at or near the measurement time and adjusting heated air and/or drying pressure based on the comparison to influence measured exhaust temperature to follow the target exhaust temperature rate; and d. estimating product moisture content for a current time during the second portion of the drying period by:

i. plotting the target exhaust temperature rate and measured exhaust temperature, each as a function of a same range of exhaust temperature relative to a same range of drying time;

ii. determining an index of target energy needed to dry the product to the current time by integrating the exhaust temperature rate function between the set point time and the current time;

iii. determining an index of current energy used to dry the product to the current time by integrating the exhaust temperature rate function between the set point time and the current time;

iv. comparing the index of target energy and the index of current energy;

v. fitting the index of current energy under the target exhaust temperature rate function to produce an index of equivalent energy;

vi. deriving an equivalent accumulated drying time for the equivalent energy by accounting for any offset of the index of equivalent energy from the index of target energy along an ideal energy function; and vii. calculating estimated current product moisture by: (initial product moisture)−(equivalent drying time/target drying rate).

2. The method of claim 1, further comprising estimating current drying rate by: (current time)/(initial product moisture-current product moisture).

3. The method of claim 1, wherein the product is seed corn.

4. The method of claim 3, further comprising setting an initial inlet air temperature that is proportional with initial seed moisture.

5. The method of claim 1, wherein the product comprises granular matter.

6. The method of claim 1, wherein the product comprises particulate matter.

7. The method of claim 1, wherein the product is dried in a double-pass dryer.

8. The method of claim 1, wherein the product is dried in a single-pass dryer.

9. The method of claim 1, wherein the target drying rate is 4.00 hours per point.

10. The method of claim 1, wherein the step of adjusting heated air and/or drying pressure based on the comparison between the measured exhaust temperature and the target exhaust temperature rate at or near the measurement time comprises adjusting the heated air.

11. The method of claim 10, wherein the step of adjusting the heated air comprises adjusting an inlet air temperature.

12. The method of claim 1, wherein the step of adjusting heated air and/or drying pressure based on the comparison between the measured exhaust temperature and the target exhaust temperature rate at or near the measurement time comprises adjusting the drying pressure.

13. The method of claim 11, further comprising setting a maximum allowed inlet air temperature, wherein the step of adjusting the heated air based on the comparison between the measured exhaust temperature and the target exhaust temperature rate at or near the measurement time comprises adjusting the inlet air temperature so long as the maximum allowed inlet air temperature is not exceeded.

14. The method of claim 1, wherein the step of adjusting heated air and/or drying pressure based on the comparison between the measured exhaust temperature and the target exhaust temperature rate at or near the measurement time comprises adjusting both the heated air and the drying pressure.

15. The method of claim 14, wherein the step of adjusting the heated air comprises adjusting an inlet air temperature.

16. The method of claim 15, further comprising setting a maximum allowed inlet air temperature, wherein the step of adjusting both the heated air and the drying pressure based on the comparison between the measured exhaust temperature and the target exhaust temperature rate at or near the measurement time comprises adjusting both the heated air and the drying pressure so long as the maximum allowed inlet air temperature is not exceeded.

17. The method of claim 1, wherein the step of adjusting heated air and/or drying pressure based on the comparison between the measured exhaust temperature and the target exhaust temperature rate at or near the measurement time is manually conducted by an operator.

18. The method of claim 1, wherein the step of adjusting heated air and/or drying pressure based on the comparison between the measured exhaust temperature and the target exhaust temperature rate at or near the measurement time is automatically conducted by a programmable controller device.

19. The method of claim 18, wherein the programmable controller device is positioned in operative communication with an exhaust temperature sensor for measuring the actual exhaust temperature.

20. The method of claim 18, wherein the programmable controller device is positioned in operative communication with a source of adjustable temperature air in fluid communication with the drying bin.

* * * * *